US006676330B2

(12) United States Patent
Stamm et al.

(10) Patent No.: US 6,676,330 B2
(45) Date of Patent: Jan. 13, 2004

(54) METHOD OF ERECTING ELEVATED ROADWAYS ABOVE EXISTING ROADWAYS WITH MINIMAL DISRUPTION OF TRAFFIC

(76) Inventors: Anna Stamm, 226 E. 10th St., #8, New York, NY (US) 10003; Eugenia Stamm, 2 Horizon Rd., #1408, Fort Lee, NJ (US) 07024; Rolan Stamm, 2 Horizon Rd., Apt. 1408, Fort Lee, NJ (US) 07024

( * ) Notice: Subject to any disclaimer, the term of this patent is extended or adjusted under 35 U.S.C. 154(b) by 0 days.

(21) Appl. No.: 10/000,267

(22) Filed: Nov. 28, 2001

(65) Prior Publication Data

US 2002/0064424 A1 May 30, 2002

Related U.S. Application Data

(60) Provisional application No. 60/250,187, filed on Nov. 30, 2000.

(51) Int. Cl.[7] ..... E01C 1/00
(52) U.S. Cl. ..... 404/1
(58) Field of Search ..... 14/77.1, 78, 18, 14/24; 404/1, 71

(56) References Cited

U.S. PATENT DOCUMENTS

| | | | | |
|---|---|---|---|---|
| 1,924,779 A | | 8/1933 | Flynn | 37/108 |
| 2,225,186 A | | 12/1940 | Sorensen | 94/1 |
| 3,211,110 A | | 10/1965 | Pierson | 104/123 |
| 3,301,146 A | | 1/1967 | Krug | 94/1 |
| 3,406,616 A | | 10/1968 | McLean | 94/1 |
| 3,654,652 A | * | 4/1972 | Pleasants | 14/18 |
| 3,811,147 A | | 5/1974 | Dix | 14/1 |
| 4,698,866 A | | 10/1987 | Kano | 14/1 |
| 4,953,249 A | * | 9/1990 | Warwick | 14/2.4 |
| 5,042,957 A | | 8/1991 | Arita | 404/71 |
| 5,105,494 A | | 4/1992 | Ogg | 14/78 |
| 5,846,020 A | | 12/1998 | McKeown | 404/1 |
| 5,960,502 A | | 10/1999 | Sherman | 14/77.1 |

FOREIGN PATENT DOCUMENTS

| | | | |
|---|---|---|---|
| DE | 2653515 | 1/1978 | E01C/23/06 |
| DE | 3107408 | 11/1982 | E01D/15/12 |
| EP | 424223 | 4/1991 | E01D/15/12 |
| GB | 2227268 | 7/1990 | E01D/1/00 |

* cited by examiner

*Primary Examiner*—Robert E. Pezzuto
*Assistant Examiner*—Alexandra K. Pechhold

(57) ABSTRACT

A method of erecting a new elevated roadway (41) above an existing roadway (21) in order to increase traffic capacity of bridge roadway (23) with minimal disruption of existing traffic. Roadway (41), which comprises a plurality of interconnected ramp units and bridging units, is erected in multiple steps by initially erecting entrance/exit ramp unit (46) and moveable ramp unit (45) with their uppermost ends facing each other, then intermittently, during periods of off-peak traffic, creating a gap in a previously erected portion of roadway (41) by moving ramp unit (45) along roadway (21), erecting a bridging unit in the gap, and opening an extended portion of roadway (41) to traffic in time for the next period of peak traffic. This method can be used for reconstructing different types of bridges and highways.

11 Claims, 19 Drawing Sheets

METHOD OF ERECTING ELEVATED ROADWAYS ABOVE EXISTING ROADWAYS WITH MINIMAL DISRUPTION OF TRAFFIC

CROSS-REFERENCE TO RELATED APPLICATIONS

This application is entitled to the benefit of Provisional Patent Application Serial No. 60/250,187 filed Nov. 30, 2000.

BACKGROUND

1. Field of Invention

This invention relates to the field of reconstructing existing bridges and highways, specifically to methods for increasing traffic capacity of existing roadways.

2. Prior Art

There are more and more vehicles that are using existing transportation infrastructure every year. Due to a drastic increase in traffic load and volume, traffic capacity of existing roadways is becoming inadequate. At the same time, especially in urban areas, construction of new transportation facilities is severely restricted by environmental regulations, high costs, and existing land development. Therefore, reconstructing existing bridges and highways in order to increase their traffic capacity very often remains the only choice available.

Prior art methods of reconstructing existing roadways in order to increase their traffic capacity involve either widening existing roadways, or erecting new elevated roadways above existing roadways. In urban areas, erecting new elevated roadways is used most frequently, because widening existing roadways is often constrained by right-of-way restrictions and environmental considerations. Various methods and devices have been proposed for erecting elevated roadways above existing roadways, as described in U.S. Pat. Nos. 2,225,186 to N. C. Sorensen (1940), 3,211,110 to R. M. Pierson (1965), 3,301,146 to S. Krug et al (1967), 3,406,616 to E. McLean (1968), 5,846,020 to K. McKeown (1998), 5,960,502 to Y. Sherman et al (1999), and European Patent 424223 to C. Defontaines (1991).

According to the prior art, elevated roadways are usually erected from various types of frames supporting a structural floor system and a roadway deck, or from reinforced concrete box units. Reinforced concrete systems are very heavy, which virtually precludes their use on existing bridges that are not commonly designed to support a substantial additional weight. In addition, curing of field poured concrete joints during erection of the concrete units requires significant time and leads to interruption of existing traffic. Structural steel systems of the prior art provide very few additional travel lanes; some even result in single lanes, channeling traffic. The latter is not at all acceptable as a permanent roadway due to a possibility of car or truck breakdowns.

Furthermore, erecting a new elevated roadway above an existing one using these prior art methods and devices requires at least a partial closure of the existing roadway for extended periods of time during erection, causing severe disruption of existing traffic. Even if traffic were detoured from the existing roadway undergoing reconstruction, traffic would spill over onto adjacent roadways, creating traffic jams and safety hazards resulting in increased air pollution, costly disruption of local businesses, and interference with local traffic.

Transportation authorities, such as Federal, State, and Municipal Departments of Transportation, public and private transportation agencies, that govern existing bridges and highways, recognize the problem of traffic disruption that occurs during reconstruction of existing roadways. And since traffic volumes on existing roadways vary significantly between peak and off-peak traffic, the transportation authorities issue regulations that specify when and how many of existing travel lanes shall be open to traffic, and when and how many of them may be closed with minimal disruption of existing traffic. Generally, all travel lanes of existing roadways are required to be open during periods of peak traffic, from early morning to late afternoon, but a predetermined number of travel lanes are allowed to be closed during periods of off-peak traffic, mostly during night hours, with minimal disruption of existing traffic.

The aforementioned regulations provide a window of opportunity for development of methods of erecting new elevated roadways above existing roadways with minimal disruption of traffic. Prior art has not yet successfully utilized such methods, and as a result, many existing bridges and highways, especially in urban areas, suffer from insufficient traffic capacity and remain functionally deficient for decades.

SUMMARY

In accordance with the present invention a new elevated roadway, which comprises a predetermined number of interconnected ramp units and bridging units, is erected above an existing roadway with minimal disruption of existing traffic. The new elevated roadway increases traffic capacity of the existing roadway by providing elevated travel lanes. This method is easily adapted for use on different types of bridges and highways. It is especially valuable in conjunction with car and truck traffic separation, which provides a reduction in design live load and thus compensates for additional weight of the new elevated roadway.

Objects and Advantages

Insufficient traffic capacity of existing roadways is one of the most frequently encountered problems in the field of reconstructing existing bridges and highways. The primary object of the present invention is to provide a novel, simple and economical solution, which increases traffic capacity of existing roadways with minimal disruption of existing traffic. This object is accomplished by developing methods and utilizing devices that, working synergistically, offer a complete realization of the task.

Accordingly, a highly efficient method of erecting a new elevated roadway above an existing roadway with minimal disruption of traffic is provided. In accordance with the preferred embodiment of this method, the new elevated roadway, comprising a predetermined number of interconnected ramp units and bridging units, is erected in multiple steps, mostly during periods of off-peak traffic, and, after completion of each step, it is opened to existing traffic in time for the next period of peak traffic.

The initial step of erecting the new elevated roadway involves erecting at least two entrance/exit ramp units, at least one of which is made moveable. The ramp units are positioned so that an uppermost end of one ramp unit faces an uppermost end of another ramp unit and, when erection of the ramp units is completed, they embody an initial portion of the new elevated roadway that may be opened to traffic, if specified by a transportation authority.

The next step, which is executed during a period of off-peak traffic as specified by the transportation authority, involves closing the previously erected portion of the elevated roadway to existing traffic and creating a gap in the previously erected portion of the elevated roadway by moving the moveable ramp unit along the existing roadway. A bridging unit is then erected in the gap and the moveable ramp is moved back, if necessary, to adjoin the bridging unit. Consequently, an extended portion of the elevated roadway is erected, and it is opened to existing traffic in time for the next period of peak traffic as specified by the transportation authority.

The step of closing a previously erected portion of the elevated roadway to existing traffic during a period of off-peak traffic as specified by the transportation authority, creating a gap in the previously erected portion of the elevated roadway by moving the moveable ramp unit along the existing roadway, erecting a bridging unit in the gap, and opening an extended portion of the elevated roadway to existing traffic in time for the next period of peak traffic as specified by the transportation authority is repeated many times until erection of the predetermined number of the bridging units is completed.

Thus, by utilizing the novel method of the present invention, the new elevated roadway is erected with minimal disruption of existing traffic, because, at each step, the previously erected portion of the elevated roadway is open to existing traffic during periods of peak traffic, and it is closed to existing traffic during periods of off-peak traffic.

Another major object of this invention is to shorten duration of erecting new elevated roadways. This object is achieved by utilizing space underneath previously erected ramp units and bridging units to store construction and safety equipment and materials, and to house construction field offices and staging areas, thereby saving time usually required to move these items and personnel to and from work areas.

This object is also achieved by utilizing the space underneath a moveable ramp unit for performing erecting work during periods of peak traffic. This work may include, for example, preparing an existing roadway for coming erection of bridging units or surveying condition of existing load-carrying structural members of the existing roadway. This work is time-consuming and complex, especially when performed at night, however, when the space underneath the moveable ramp unit is utilized, the work is conducted during day-time, while existing peak traffic flows overhead. As a result the quality of workmanship is improved and erecting work is continuously conducted during periods of peak traffic and periods of off-peak traffic, thereby shortening overall duration of construction.

Still another object of this invention is to make it versatile enough to be used on different types of existing bridges and highways. This object is achieved by minimizing additional dead load applied to these existing structures by utilizing various light-weight structural forms of bridging units and ramp units that amplify the advantages of the novel method of erecting new elevated roadways with minimal disruption of existing traffic.

Bridging units and ramp units are composed of individual structural members such as deck panels, stringers, braces, and of main frames consisting of columns and floor-beams. The main frames, usually of T, double-T (TT), or portal types, are generally oriented transversely to the direction of traffic, and they serve to support other structural members. The main frames and other structural members may be made of steel, aluminum, other light-weight alloys, or fiber reinforced composite materials in order to minimize their weight, which is especially important when elevated roadways are erected over existing bridges.

This object is also achieved by reducing the live load applied to new elevated roadways as well as to existing roadways. This live load reduction is realized by restricting elevated roadway traffic to "passenger cars only" traffic and by restricting existing roadway truck traffic to a minimal number of existing travel lanes as specified by the transportation authority. Since a per-lane live load imposed by truck traffic is several times higher than a per-lane live load imposed by "passenger cars only" traffic, it is possible to erect a new elevated roadway carrying several additional "passenger cars only" travel lanes without overloading the existing structure.

Another object of this invention is to achieve a higher level of safety for workers and motorists during reconstruction of existing roadways, as well as for motorists after the reconstruction is completed. This object is accomplished by adding a sufficient number of new travel lanes, therefore reducing congestion and upgrading Level-Of-Service.

A higher level of safety is also achieved by allowing "passenger cars only" traffic on new elevated roadways, thus separating car and truck traffic. Also, natural lines of separation of truck and "passenger cars only" traffic are provided on the existing roadways by lines of columns of main frames protected by traffic barriers.

Safety is also improved because construction equipment, materials and personnel need not be moved often to and from work areas, and the workers are protected from traffic by construction traffic barriers.

Furthermore, a separate travel lane designated for "emergency vehicles only" may be integrated as a safety feature as well.

Other objects, advantages and novel features of the invention will become more apparent from the following detailed description of the invention when taken in conjunction with the following examples and accompanying drawings.

DRAWINGS

Drawing Figures

In the drawings, closely related figures have the same number but different alphabetic suffixes. Likewise, closely related reference numerals have the same number but different alphabetic suffixes.

Also in the drawings:

North direction shown thus: N direction of traffic on existing roadway shown thus: ➡ direction of traffic on new elevated roadway shown thus: ⇨ direction of movement of moveable ramp unit shown thus: ⇦⇨ travel lane marking lines shown thus: — — — roadway traffic barriers shown thus: ——— construction traffic barriers shown thus: —✕—

Reference Numerals in Drawings

Figure 1:
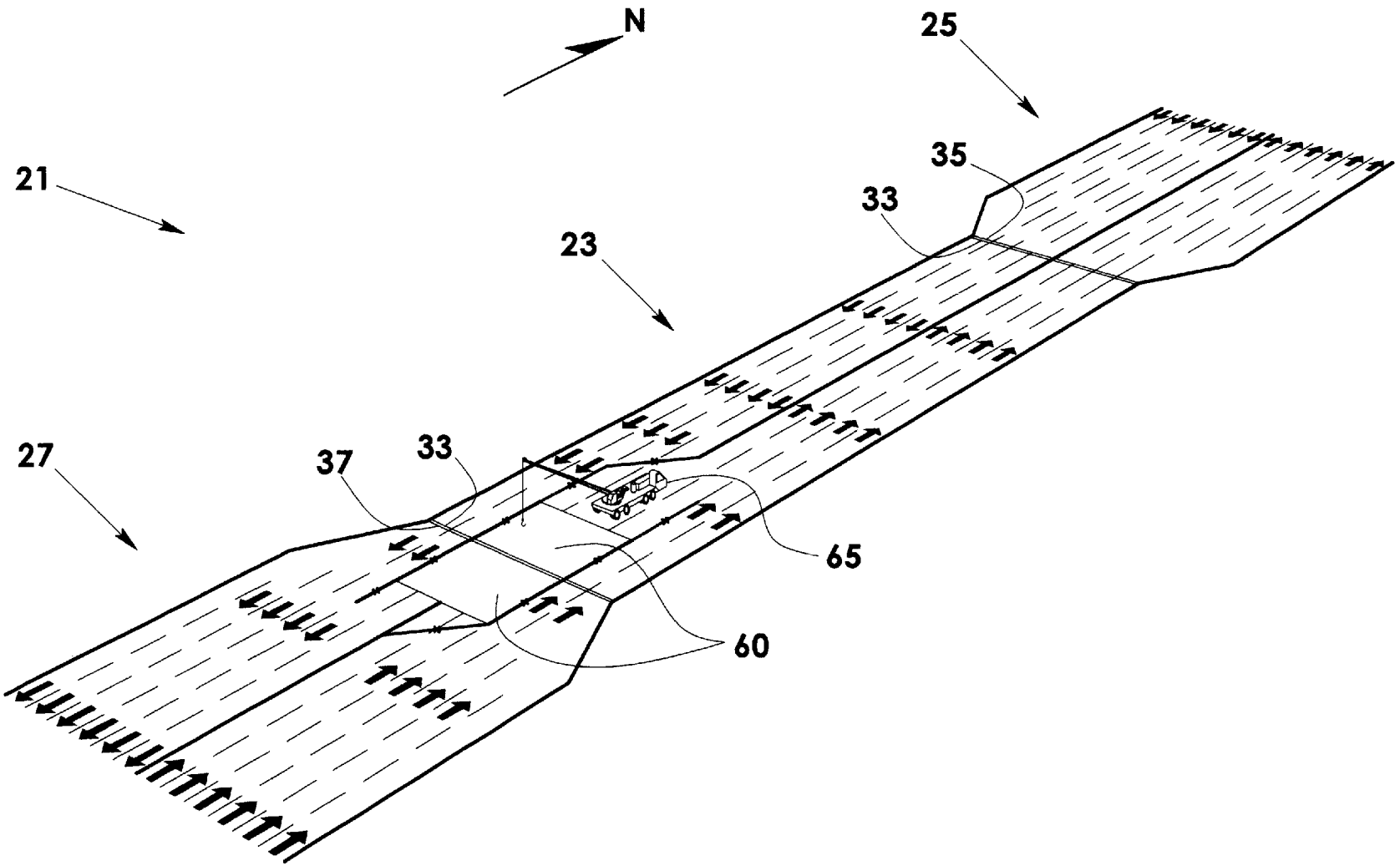
FIG. 1 (PRIOR ART)
FIG. 1 (PRIOR ART) shows a perspective view of an existing roadway that is being reconstructed utilizing prior art methods.

21 existing roadway
23 existing bridge roadway
25 existing north approach roadway
27 existing south approach roadway
33 existing bridge roadway limit line
35 existing north approach roadway limit line
37 existing south approach roadway limit line
39E, 39W local roadway
40 initial portion of new elevated roadway
40A, 40C extended portion of new elevated roadway
41 new elevated roadway
42, 43 alternative new elevated roadway
44 additional new elevated roadway
45 moveable ramp unit
46 ramp unit
47A, 47B, 47C, 47F, 47G bridging unit with portal-type main frame
47M, 47N bridging unit with double-T-type main frame
48A, 48B additional bridging unit
49A, 49B additional ramp unit
50 existing load-carrying structural member
51 portal-type main frame of bridging unit
53 double-T-type main frame of bridging unit
55 T-type main frame of bridging unit
57 base sub-unit of bridging unit
58 elevated sub-unit of bridging unit
60 new elevated roadway construction work area (prior art)
65 construction equipment
66 contractor's field office

DETAILED DESCRIPTION

Description and Operation of Preferred Embodiment

In the first example, FIG. 1 (PRIOR ART) shows a perspective view of an existing roadway 21 running north-south. Roadway 21, which is governed by a transportation authority, includes an existing bridge roadway 23, limited by existing bridge roadway limit lines 33. Roadway 21 also includes an existing north approach roadway 25, limited by an existing north approach roadway limit line 35, and an existing south approach roadway 27, limited by an existing south approach roadway limit line 37. Travel lane marking lines delineate existing northbound travel lanes and existing southbound travel lanes. The northbound and southbound travel lanes are separated at a median and limited on sides by roadway traffic barriers.

Existing traffic on roadway 21 fluctuates between periods of peak traffic, from early morning to late afternoon, and periods of off-peak traffic, during night hours. While average daily traffic requires four travel lanes in each direction, peak traffic requires six travel lanes in each direction, and off-peak traffic requires two travel lanes in each direction. Approach roadways 25 and 27 have been widened in order to satisfy peak traffic, that is, they provide six northbound travel lanes and six southbound travel lanes. However, widening of bridge roadway 23 could not be implemented due to environmental restrictions, so that it provides only four northbound travel lanes and four southbound travel lanes, creating a condition commonly known as a bottleneck during periods of peak traffic.

Since, as mentioned above, widening of bridge roadway 23 could not be implemented, a conceivable solution to remedy insufficient traffic capacity of bridge roadway 23 during periods of peak traffic is to erect a new elevated roadway that will provide two elevated travel lanes in each direction. The start-up of such erecting using prior art methods is shown in FIG. 1 (PRIOR ART). It can be seen that a new elevated roadway construction work area 60 and construction equipment 65, protected by construction traffic barriers, are severely disrupting existing traffic on bridge roadway 23 by leaving only two travel lanes in each direction open to existing traffic. As erection will progress north using prior art methods, traffic disruption will continue for the duration of erecting the new elevated roadway.

The following text and drawings provide a complete description of the novel method of erecting a new elevated roadway 41 (see FIG. 5B) above existing roadway 21 with minimal disruption of existing traffic.

The new elevated roadway will comprise a predetermined number of interconnected entrance/exit ramp units and bridging units. For clarity of presenting the method of erecting the new elevated roadway, the ramp units and the bridging units are shown in the majority of the drawings as undivided units. Actually, they will most likely be erected from individual structural members such as frames, beams, and deck panels, or from pre-assembled sub-units. However, regardless of the actual pattern of erecting the new elevated roadway, the terms, ramp unit(s) and bridging unit(s), will be utilized in describing the novel method of the present invention.

According to standard practice, erecting procedures include but are not limited to directing and maintaining existing traffic, bringing in all necessary construction equipment and safety devices, surveying and making necessary adjustments to the existing roadway, installing, connecting and disconnecting ramp units and bridging units to each other and to the existing roadway, and removing construction equipment and safety devices from the roadways prior to opening them to existing traffic.

Figure 2A:
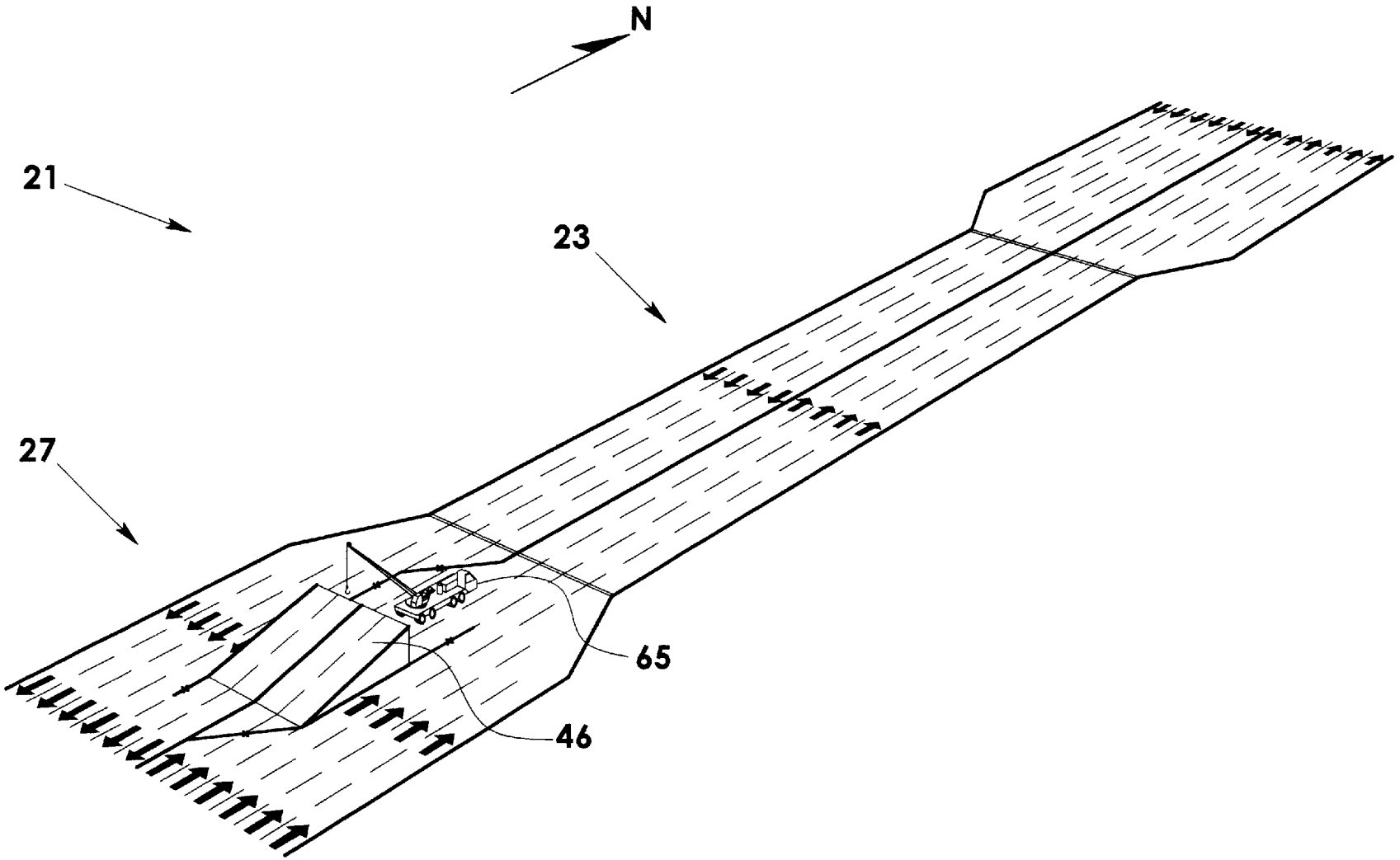
FIGS. 2A and 2B show perspective views of the existing roadway during an initial step of erecting a new elevated roadway.
Figure 2B:
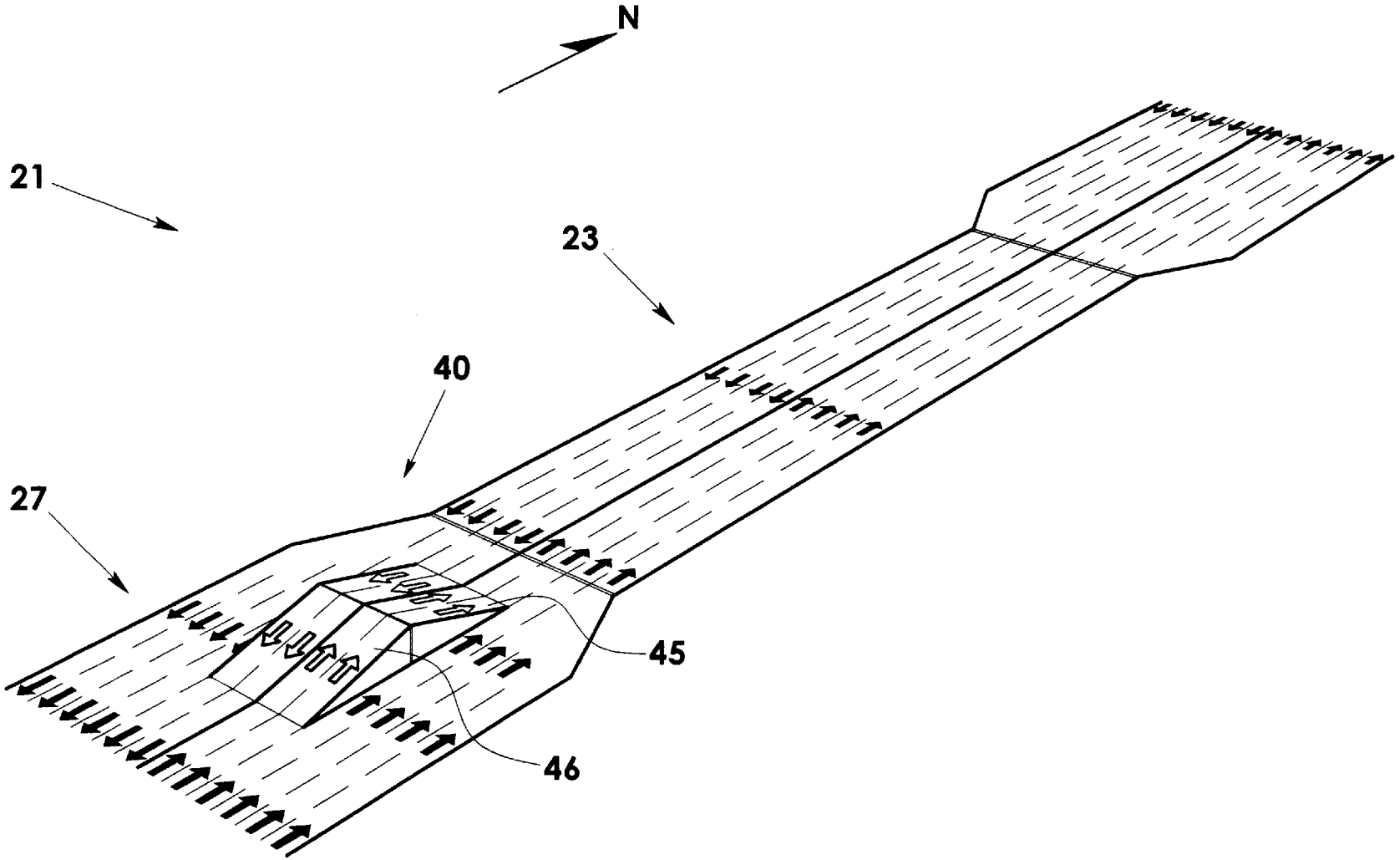

FIGS. 2A and 2B show perspective views of the same existing roadway 21 during an initial step of erecting the new elevated roadway according to the preferred embodiment of the present invention. This initial step comprises the erecting of two entrance/exit ramp units, one of which is a moveable ramp unit.

The moveable ramp unit will most likely be composed of several sub-units, which will be joined together by fixed or flexible connections. The moveable ramp unit may be required to be flexible longitudinally, transversely, and vertically in order to provide for an existing roadway's horizontal and vertical curve alignments and varying cross-slopes. The sub-units may be supported by rollers, sliders, pneumatic wheels, or other means, may be mounted on trailer-type platforms, or may run on a light rail-type system. The moveable ramp unit may be self-propelling, or it may be propelled along the existing roadway by an outside source, like a tractor or a cable-winch system. The moveable ramp unit may be moved as a single unit or the sub-units can be moved in sequential order, thereby reducing power requirements.

Space underneath the moveable ramp unit can be used to stage construction work, store construction means, such as construction equipment and traffic barriers, and house a contractor's field office. This greatly minimizes the need to repeatedly move construction means and workers to and from the actual construction work area, thus reducing non-productive work, time loss, and disruption of existing traffic.

The erection, as seen in FIG. 2A, involves closing four center travel lanes (two leftmost lanes in each direction) on approach roadway 27 to existing traffic by using construction traffic barriers, moving in construction equipment 65, and erecting a ramp unit 46.

As shown in FIG. 2B, a moveable ramp unit 45 has been erected next to ramp unit 46 so that an uppermost end of ramp unit 45 faces an uppermost end of ramp unit 46. It can also be seen that the construction traffic barriers have been removed from approach roadway 27, and an initial portion of new elevated roadway 40, providing two new elevated northbound travel lanes and two new elevated southbound travel lanes, is open to existing traffic as specified by the governing transportation authority.

During the erection of ramp units 45 and 46, as seen in FIGS. 2A and 2B, at least four travel lanes in each direction remained open to existing traffic on approach roadway 27 and bridge roadway 23. And since bridge roadway 23 provided four travel lanes in each direction prior to the beginning of erecting the new elevated roadway, ramp units 45 and 46 have been erected with minimal disruption of existing traffic.

Figure 3A:
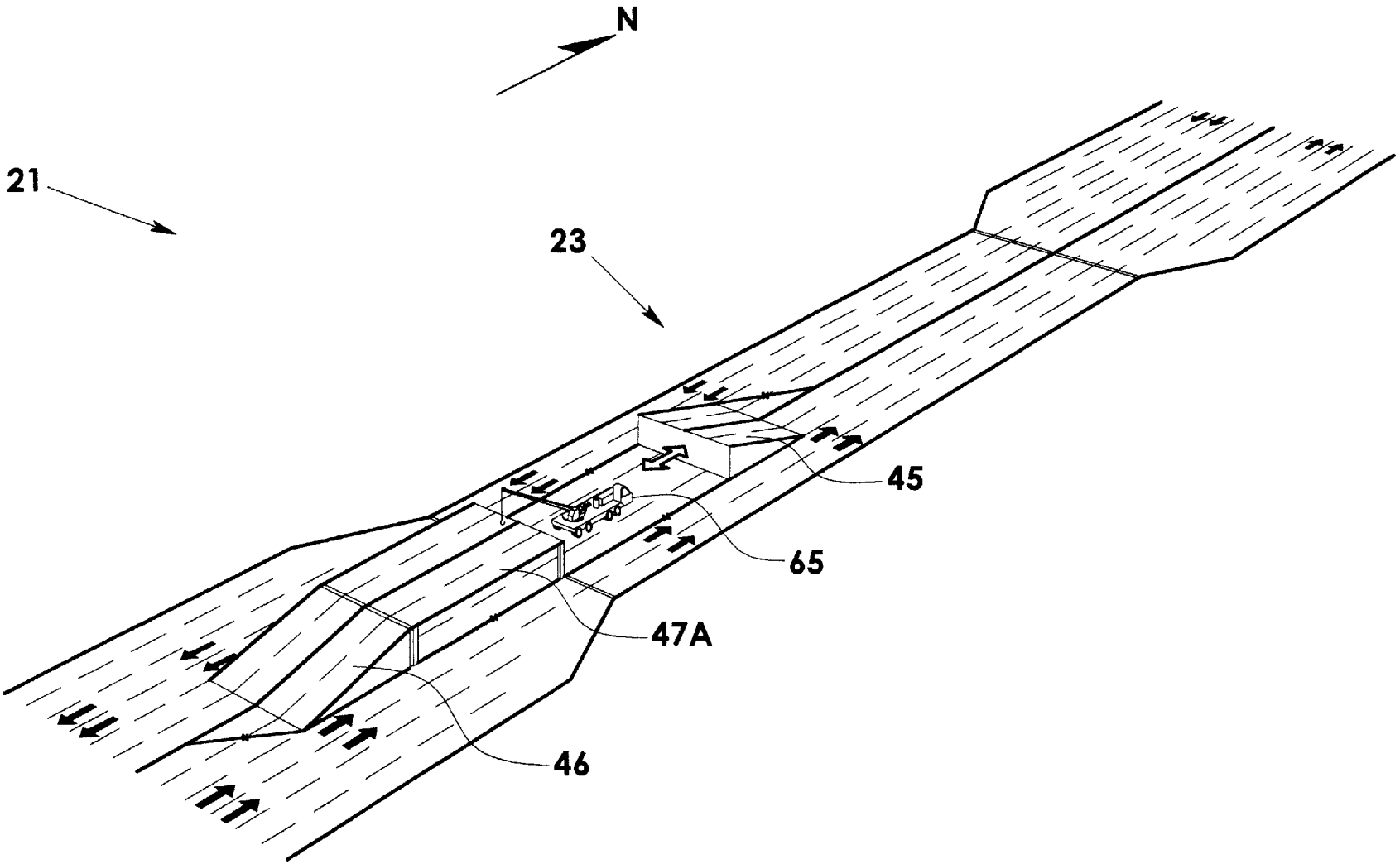
FIGS. 3A and 3B show perspective views of the existing roadway during a subsequent step of erecting the new elevated roadway.
Figure 3B:
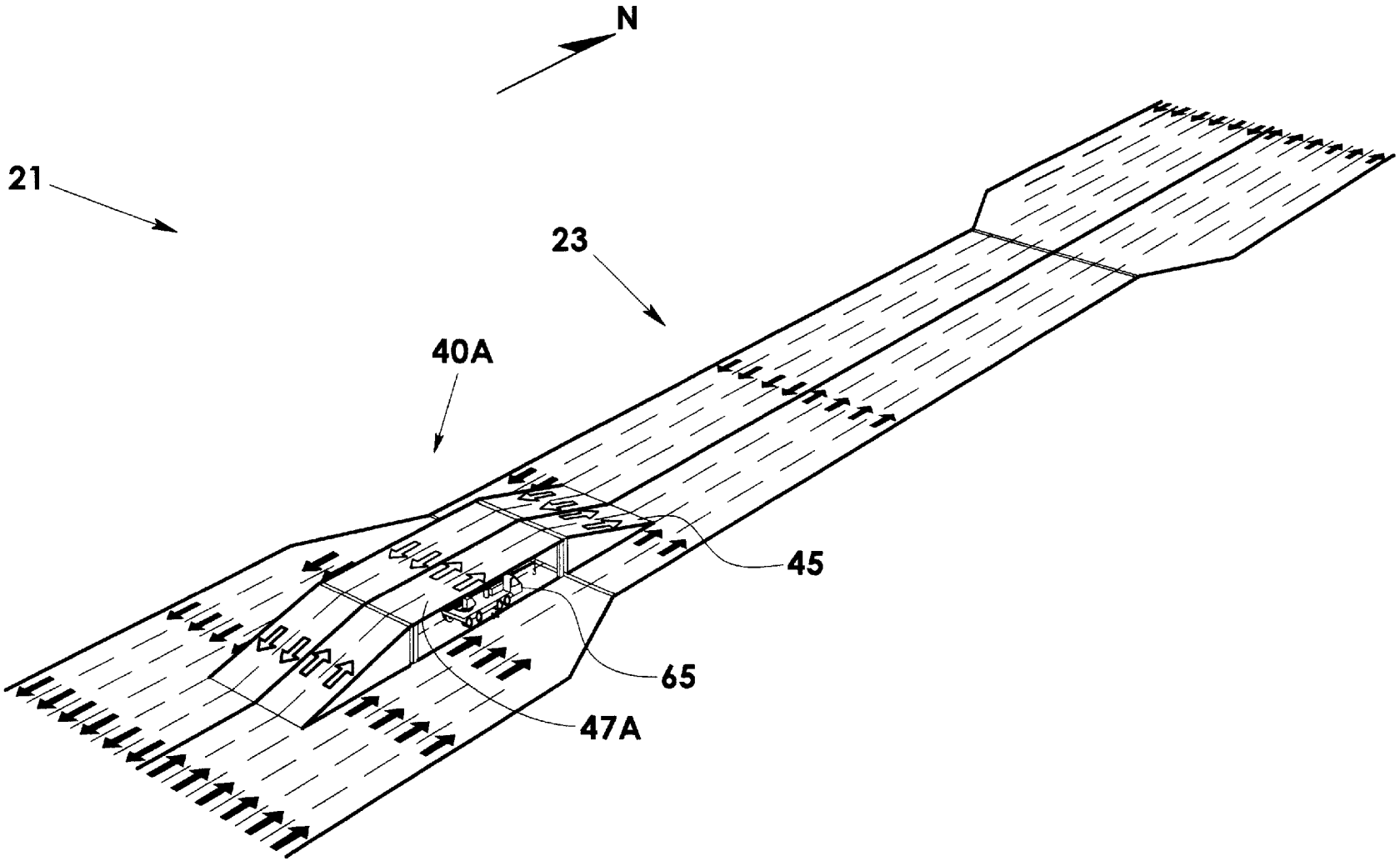

FIGS. 3A and 3B show perspective views of existing roadway 21 during a subsequent step of erecting the new elevated roadway, which is the erection of a bridging unit 47A. As shown in FIG. 3A, this erecting involves closing the previously erected initial portion of the new elevated roadway to existing traffic during a period of off-peak traffic as specified by the transportation authority, and creating a gap between ramp unit 45 and ramp unit 46 by moving ramp unit 45 along existing roadway 21. Then, construction equipment 65 is moved in, and bridging unit 47A is erected.

As seen in FIG. 3B, construction equipment 65 has been stored under the newly erected bridging unit 47A, ramp unit 45 has been moved back along existing roadway 21 to adjoin bridging unit 47A, construction traffic barriers have been removed from existing roadway 21, and an extended portion of new elevated roadway 40A is opened in time for the next period of peak traffic as specified by the transportation authority.

As shown in FIG. 3A, two travel lanes in each direction are open to exiting traffic on bridge roadway 23 during erection of bridging unit 47A. And, since off-peak traffic requires only two travel lanes in each direction, bridging unit 47A is erected with minimal disruption of existing traffic.

As seen in FIG. 3B, two new elevated travel lanes in each direction are open to existing traffic in addition to two existing travel lanes in each direction on bridge roadway 23; therefore, four travel lanes in each direction are available to existing traffic. This is equal to the traffic capacity of bridge roadway 23 (four travel lanes in each direction) prior to the beginning of erecting the new elevated roadway, therefore, disruption of existing traffic during this step of erecting is minimal.

Figure 4A:
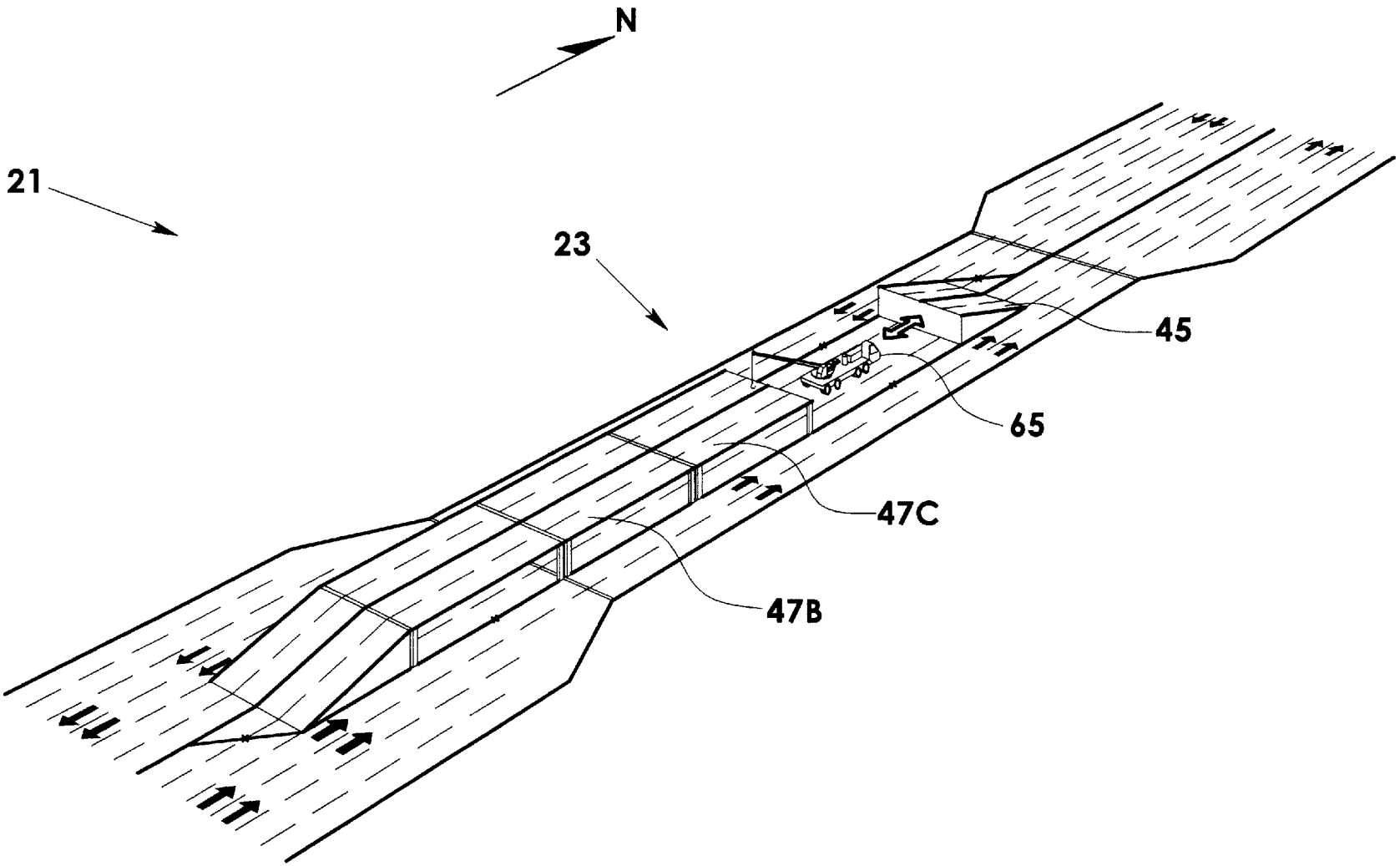
FIGS. 4A and 4B show perspective views of the existing roadway during an intermediate step of erecting the new elevated roadway.
Figure 4B:
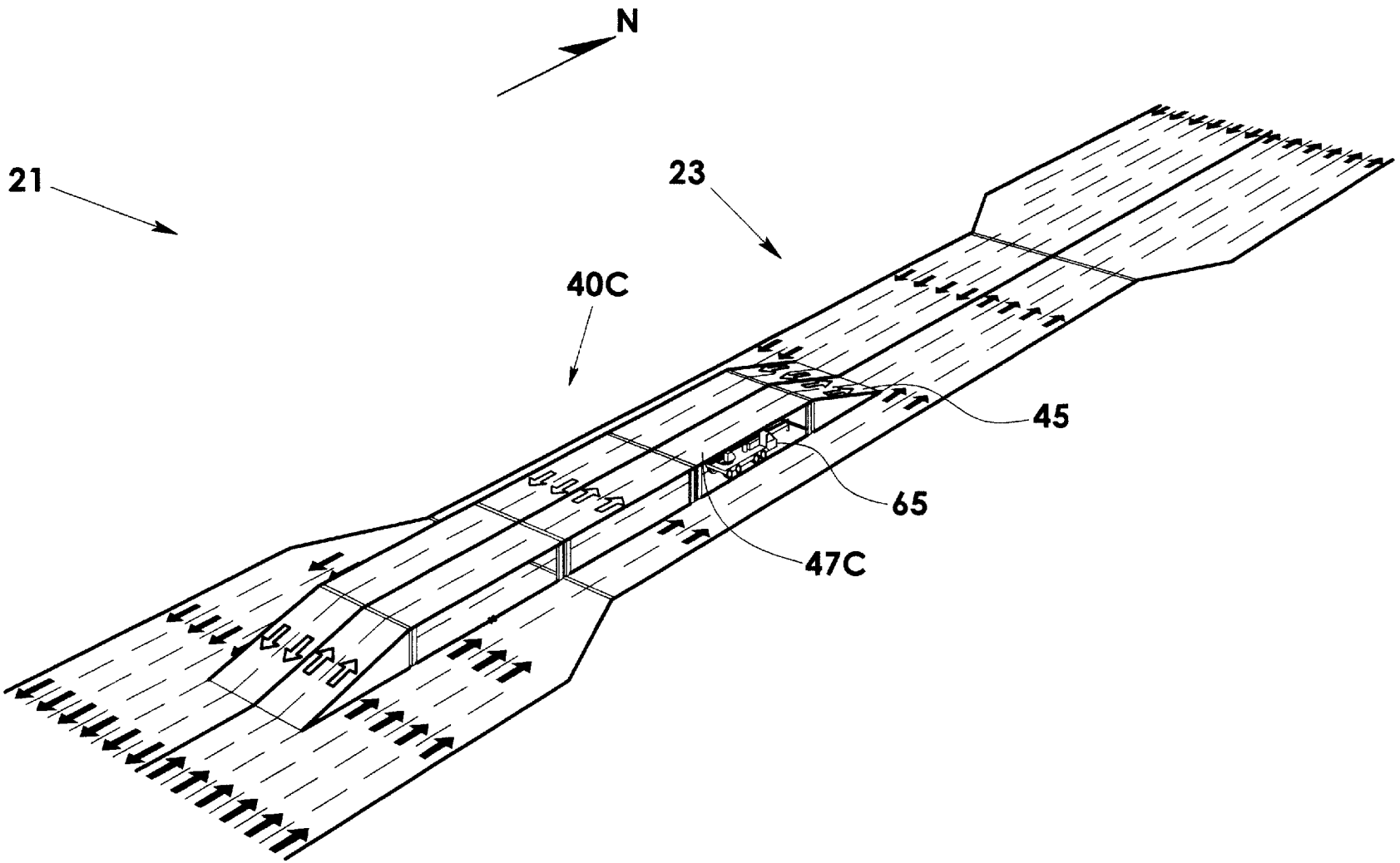

FIGS. 4A and 4B show perspective views of existing roadway 21 during an intermediate step of erecting the new elevated roadway, which is the erection of a bridging unit 47C. As shown in FIG. 4A, this erecting involves closing a previously erected portion of the new elevated roadway to existing traffic during a period of off-peak traffic as specified by the transportation authority, and creating a gap between a bridging unit 47B and ramp unit 45 by moving ramp unit 45 along existing roadway 21. Then, construction equipment 65 is moved in, and bridging unit 47C is erected.

As seen in FIG. 4B, construction equipment 65 has been stored under the newly erected bridging unit 47C, ramp unit 45 has been moved back along existing roadway 21 to adjoin bridging unit 47C, construction traffic barriers have been removed from existing roadway 21, and an extended portion of new elevated roadway 40C is opened in time for the next period of peak traffic as specified by the transportation authority.

As shown in FIG. 4A, two travel lanes in each direction are open to existing traffic on bridge roadway 23 during erection of bridging unit 47C. And, since off-peak traffic requires only two travel lanes in each direction, bridging unit 47C is erected with minimal disruption of existing traffic.

As seen in FIG. 4B, two new elevated travel lanes in each direction are open to existing traffic in addition to two existing travel lanes in each direction on bridge roadway 23; therefore, four travel lanes in each direction are available to existing traffic. This is equal to the traffic capacity of bridge roadway 23 (four travel lanes in each direction) prior to the beginning of erecting the new elevated roadway, therefore, traffic disruption during this step of erecting is minimal.

Subsequent bridging units are erected in the same manner as described above for bridging unit 47C.

Figure 5A:
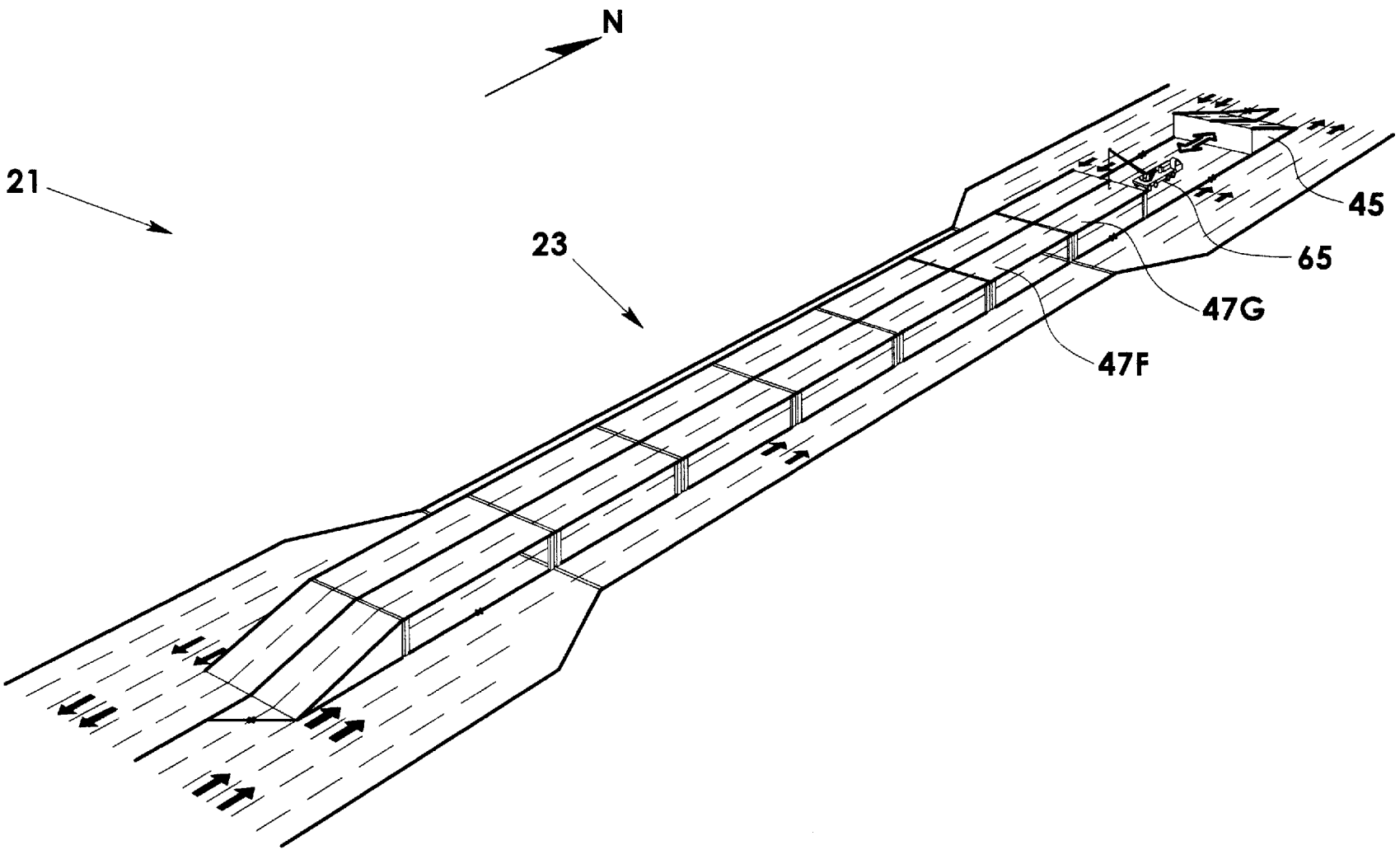
FIGS. 5A and 5B show perspective views of the existing roadway during the final step of erecting the new elevated roadway.
Figure 5B:
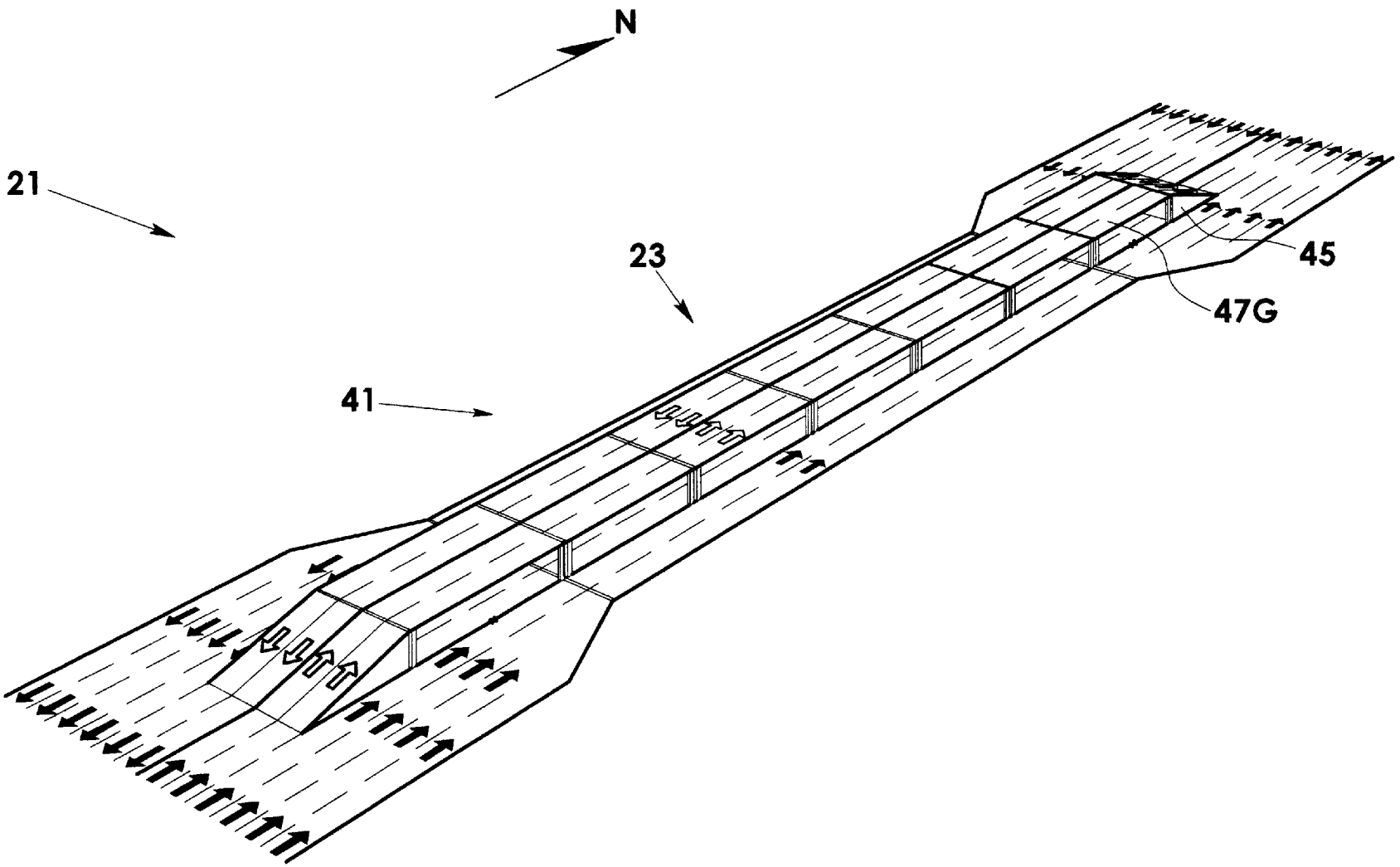

FIGS. 5A and 5B show perspective views of roadway 21 during the final step of erecting the new elevated roadway, which is the erection of a bridging unit 47G. As shown in FIG. 5A, this erecting involves closing a previously erected portion of the new elevated roadway to existing traffic during a period of off-peak traffic as specified by the transportation authority, and creating a gap between a bridging unit 47F and ramp unit 45 by moving ramp unit 45 along existing roadway 21. Then, construction equipment 65 is moved in, and bridging unit 47G is erected.

As seen in FIG. 5B, the construction equipment has been removed from existing roadway 21, ramp unit 45 has been moved back along roadway 21 to adjoin bridging unit 47G and has been fixed to existing roadway 21, construction traffic barriers have been removed from existing roadway 21, and elevated roadway 41 is opened in time for the next period of peak traffic as specified by the transportation authority.

As shown in FIG. 5A, two travel lanes in each direction are open to existing traffic on bridge roadway 23 during erection of bridging unit 47G. And, since off-peak traffic requires only two travel lanes in each direction, bridging unit 47G is erected with minimal disruption of existing traffic.

As seen in FIG. 5B, two new elevated travel lanes in each direction are open to existing traffic in addition to two existing travel lanes in each direction on bridge roadway 23, therefore four travel lanes in each direction are available to existing traffic. This is equal to the traffic capacity of bridge roadway 23 (four travel lanes in each direction) prior to the beginning of erecting the new elevated roadway, therefore disruption of existing traffic during this step of erecting, as well as during the erection of the entire new elevated roadway, is minimal.

Figure 6A:
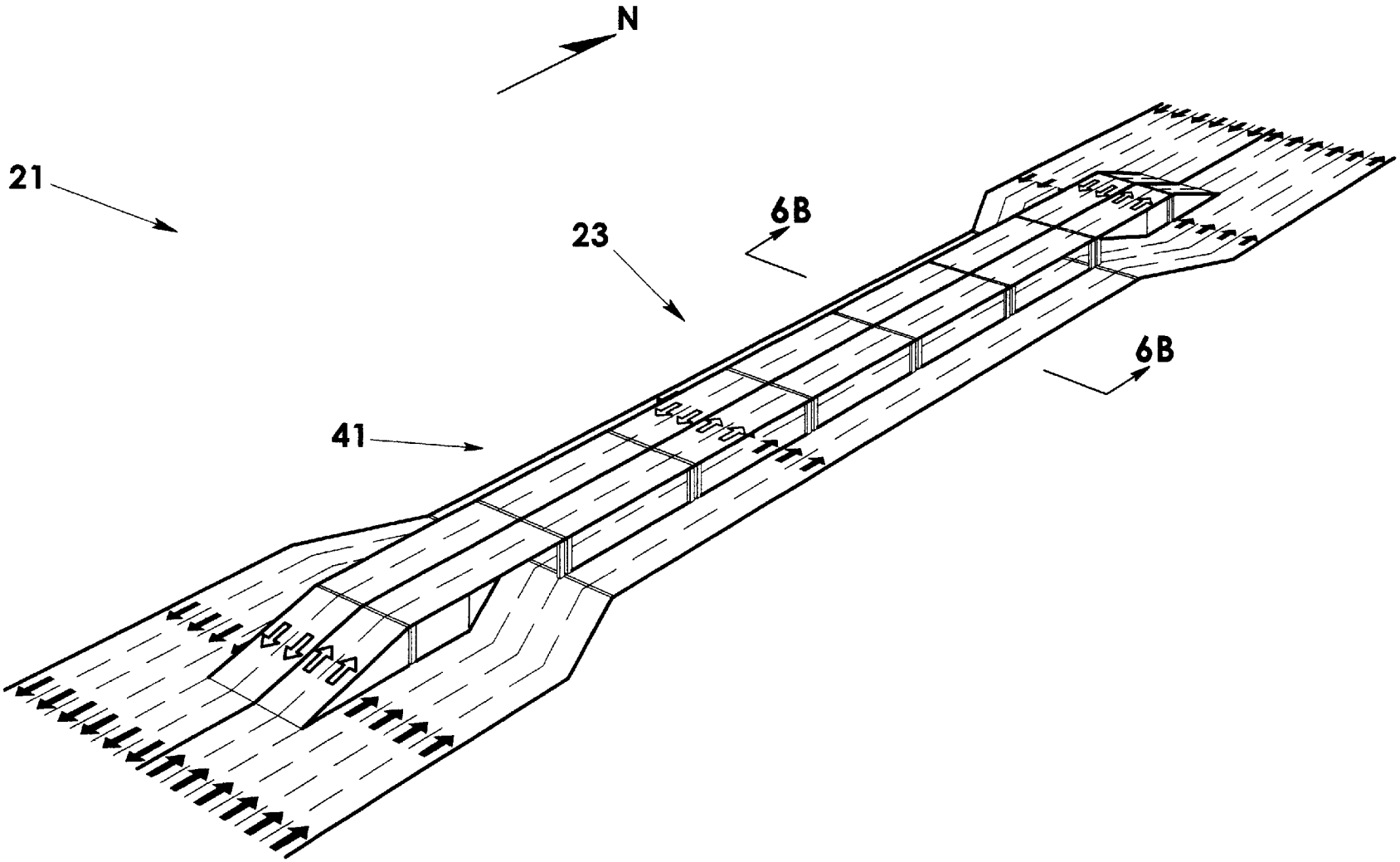
FIG. 6A and 6B show a perspective view and a cross-sectional view, respectively, of the existing roadway and the new elevated roadway after erection of the new elevated roadway has been completed.

FIG. 6A shows a perspective view of existing roadway 21 after erection of elevated roadway 41 has been completed with minimal disruption of existing traffic. All eight travel lanes (four lanes in each direction) of bridge roadway 23 as well as all four travel lanes (two lanes in each direction) of elevated roadway 41 are open to existing traffic, providing a total of six travel lanes in each direction. Thus, the insufficient traffic capacity of bridge roadway 23 has been remedied and the pre-existing bottleneck condition has been eliminated by the addition of elevated roadway 41, erected with minimal disruption of existing traffic.

Figure 6B:
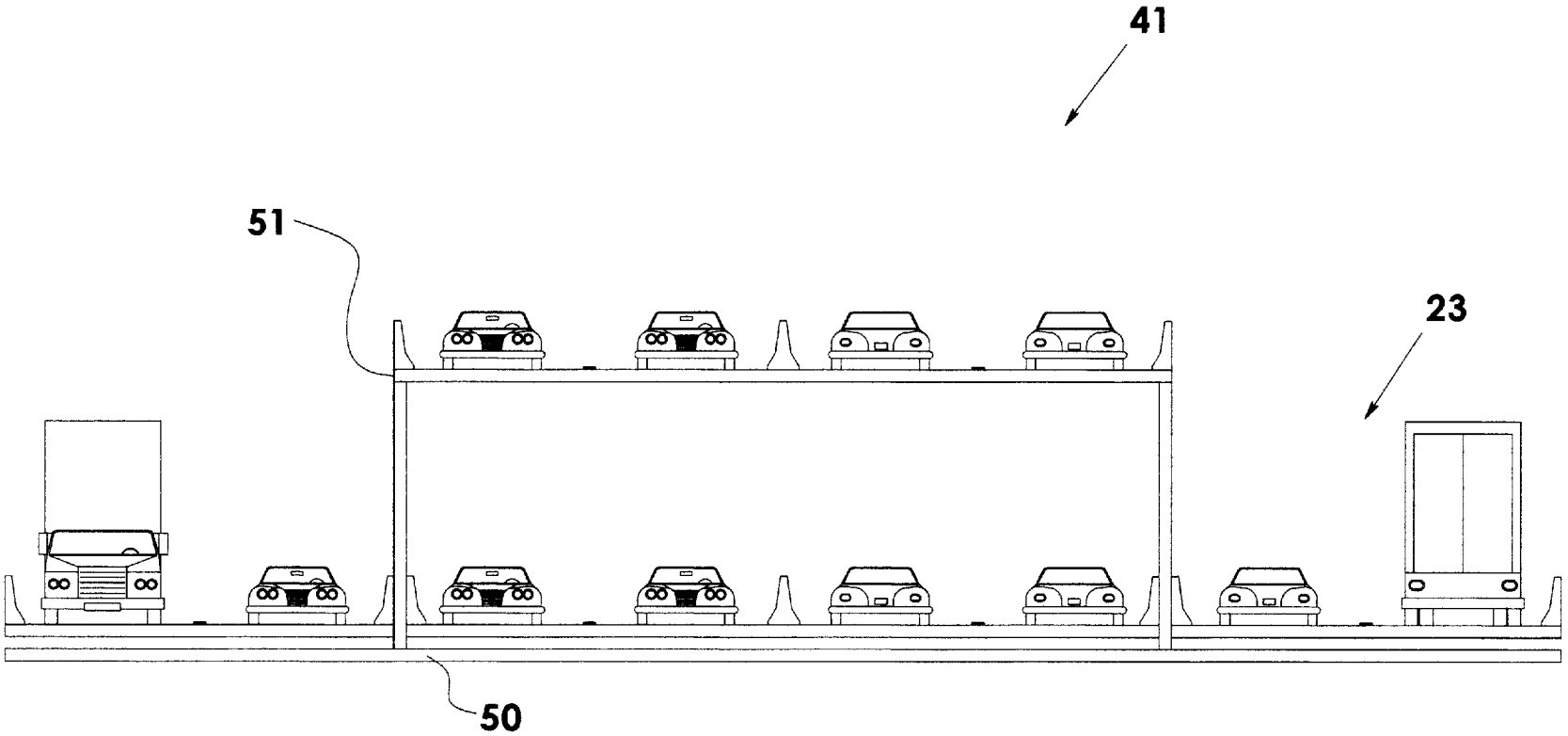

FIG. 6B shows a cross-sectional view (looking North) of bridge roadway 23 and elevated roadway 41 for the same traffic pattern as shown in FIG. 6A. It can be seen that elevated roadway 41 is erected from bridging units with portal-type main frames 51, which are supported by load-carrying members 50 of bridge roadway 23.

This type of main frame of bridging units is shown in all previous drawings; however, other types of main frames of bridging units may also be used in conjunction with the novel method of the present invention.

Figure 6C:
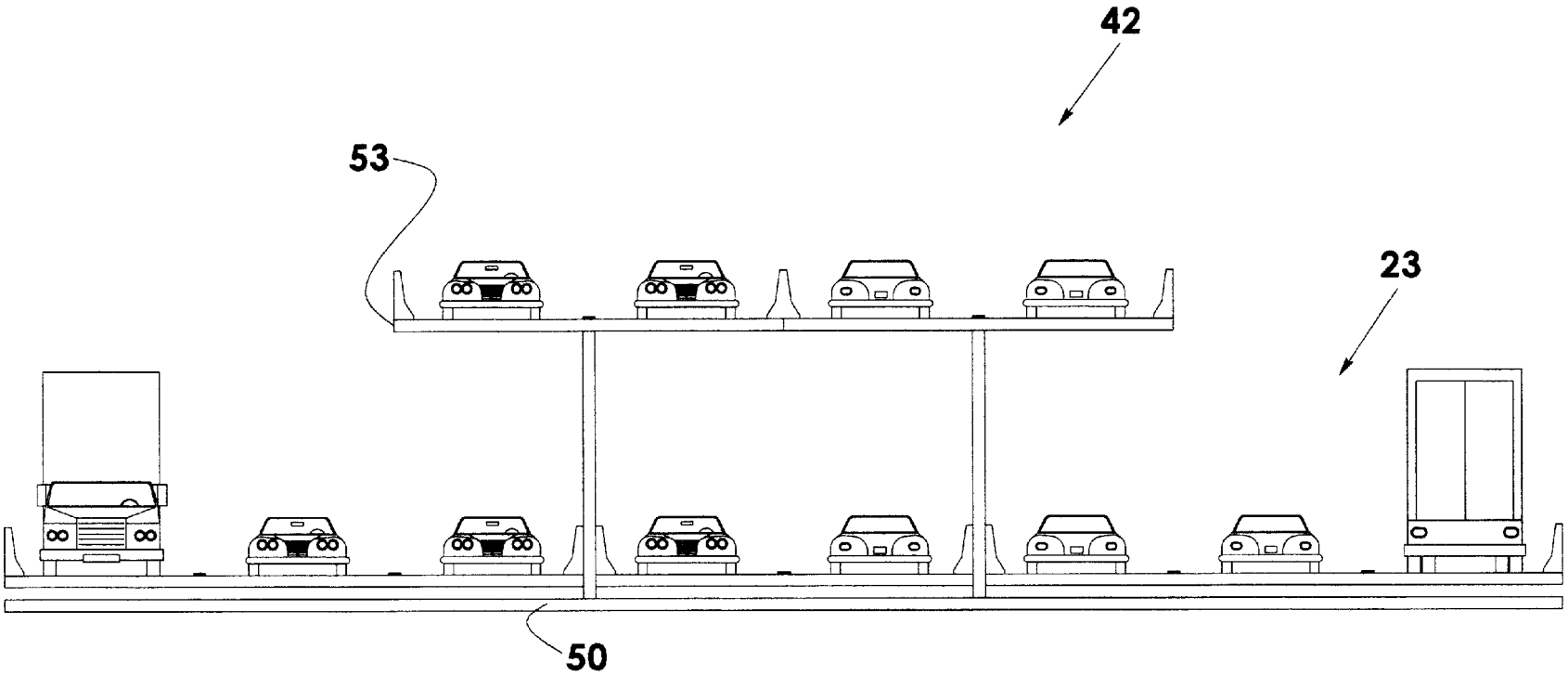
FIGS. 6C and 6D show cross-sectional views of the existing roadway and alternative new elevated roadways, which have been erected from bridging units with double-T-type and T-type main frames, respectively.

FIG. 6C shows a cross-sectional view of bridge roadway 23 and an alternative new elevated roadway 42, erected from bridging units with double-T-type main frames 53, which are supported by load-carrying members 50 of bridge roadway 23.

Figure 6D:
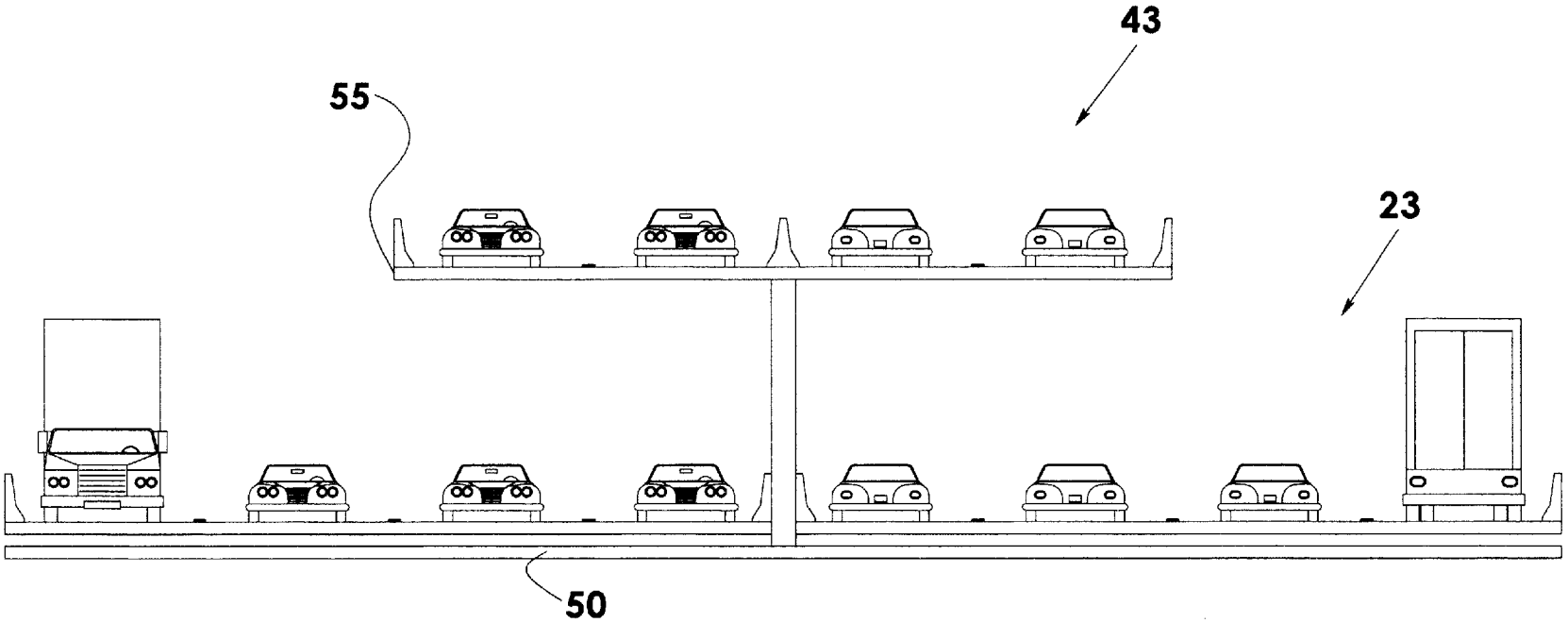

FIG. 6D shows a cross-sectional view of bridge roadway 23 and an alternative new elevated roadway 43, erected from bridging units with T-type main frames 55, which are supported by load-carrying members 50 of bridge roadway 23.

Rows of columns of portal-type main frames and double-T-type main frames of bridging units provide means of separating truck and "passenger cars only" traffic on the existing roadway. Also, the portal-type main frames of bridging units allow height reduction of the elevated roadway in order to satisfy vertical clearance limitations on the existing roadway. On the other hand, T-type main frames of bridging units allow truck traffic access to all travel lanes of the existing roadway as may be required on some truck routes.

Description and Operation of Additional Embodiments

The next example assumes that two additional travel lanes in the northbound direction are required to be built along the same existing bridge roadway 23 in order to provide a connector road from a local roadway 39E to a local roadway 39W. This requirement may be satisfied by erecting an additional two-lane elevated roadway above the two rightmost northbound travel lanes of bridge roadway 23 and alongside the previously erected elevated roadway 41 using the preferred method of the present invention. However, an alternative method of erecting a new elevated roadway with minimal disruption of traffic will be utilized for erecting the additional elevated roadway.

According to this alternative method, a new elevated roadway is erected above an existing roadway in multiple steps utilizing a predetermined number of ramp units and bridging units. This alternative method of the present invention provides a greater flexibility in the sequencing of erecting entrance/exit ramp units and bridging units than the preferred embodiment. Entrance/exit ramp units and bridging units are erected at predetermined locations at such a time that disruption of existing traffic will be minimal as specified by a governing transportation authority. Each step of erecting a bridging unit comprises closing a predetermined number of existing travel lanes to existing traffic during a period of off-peak traffic as specified by the transportation authority, erecting at least one bridging unit over the closed existing travel lanes, and opening the previously closed travel lanes beneath the erected portion of the new elevated roadway to existing traffic in time for the next period of peak traffic as specified by the transportation authority.

This alternative method is further described in the following text and FIGS. 7A, 7B, and 7C, which show perspective views of existing roadway 21, elevated roadway 41, and local roadways 39E and 39W during various steps of erecting an additional new elevated roadway 44 with minimal disruption of existing traffic on bridge roadway 23.

Figure 7A:
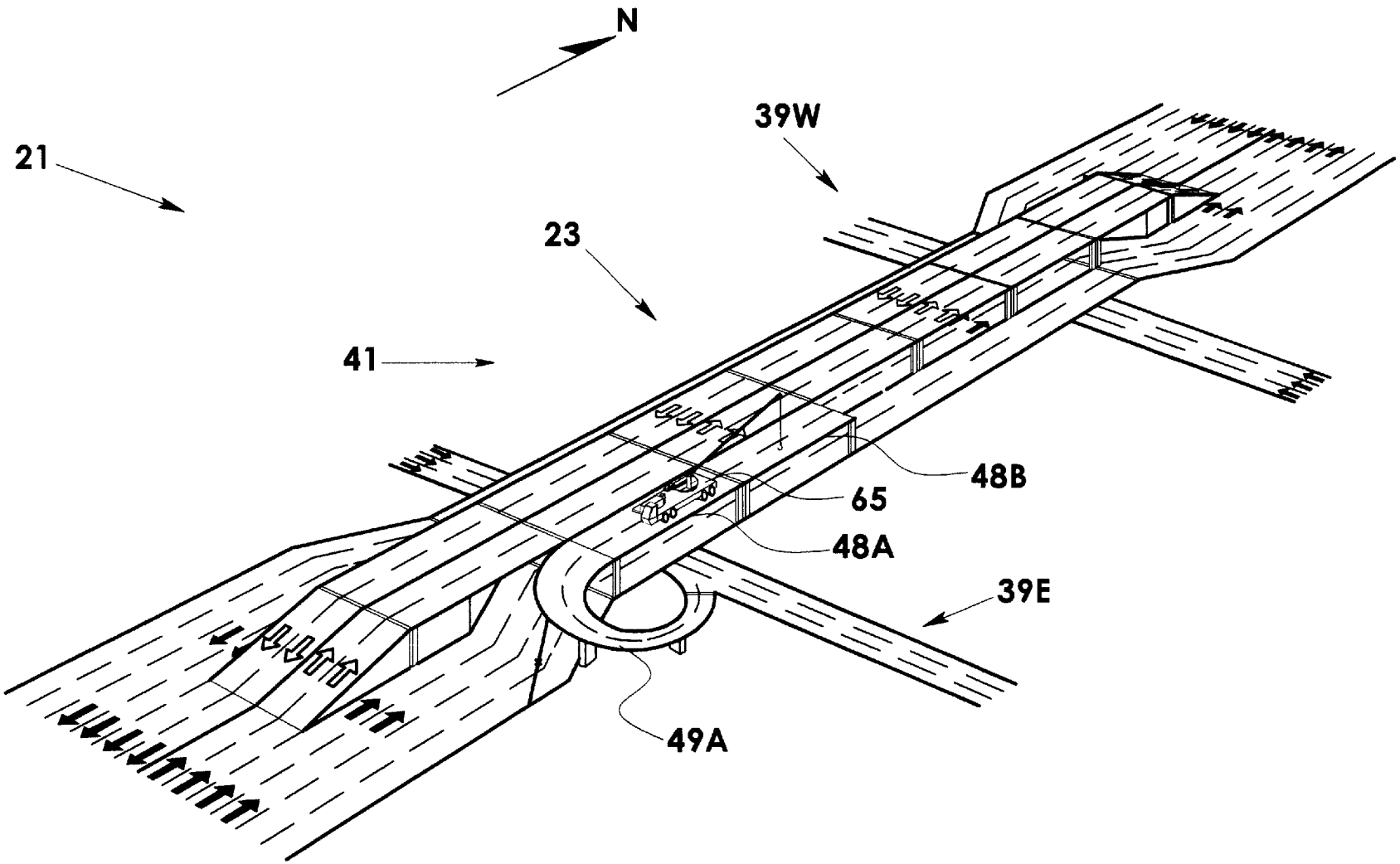
FIGS. 7A and 7B show perspective views of the existing roadway, new elevated roadway, and two local roadways during erection, in two consecutive sub-steps, respectively, of a bridging unit of an additional new elevated roadway.
Figure 7B:
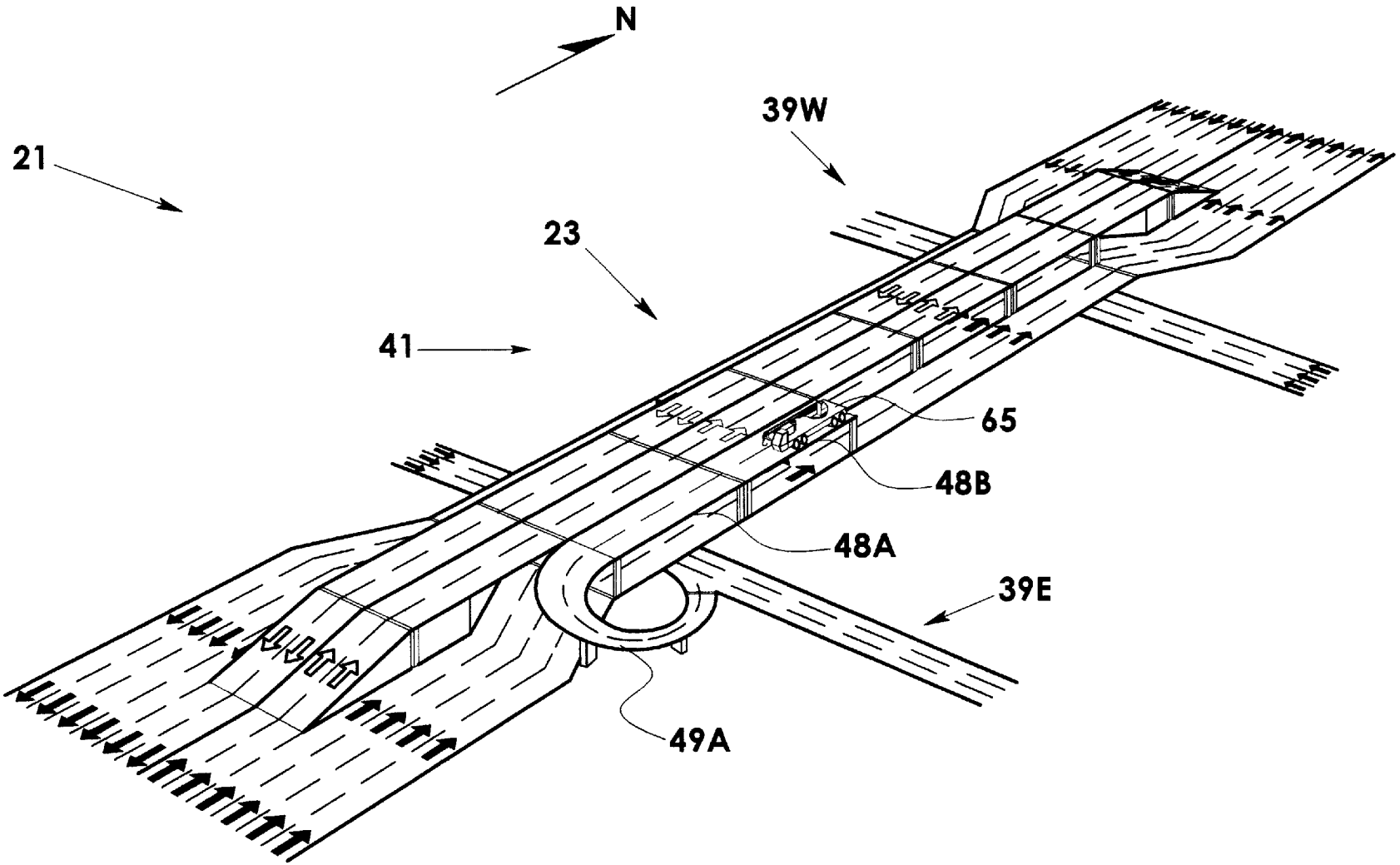

FIGS. 7A and 7B show two consecutive sub-steps, respectively, of erecting a bridging unit 48B.

FIG. 7A shows that an additional ramp unit 49A and an additional bridging unit 48A have been previously erected and they have been used to set up construction equipment 65 and to deliver other construction means and materials to the work area. It can also be seen in FIG. 7A that the two rightmost northbound travel lanes of bridge roadway 23 are closed to existing traffic using construction traffic barriers during a period of off-peak traffic as specified by the transportation authority. Existing traffic is diverted onto the remaining northbound travel lanes and a bridging unit 48B is then erected using construction equipment 65 with minimal disruption of existing traffic.

Then, as can be seen in FIG. 7B, construction equipment 65 and other construction means have been stored on the previously erected bridging unit 48B, construction traffic barriers have been removed from the existing roadways, and the two rightmost northbound travel lanes are opened beneath bridging units 48A and 48B, and ramp unit 49A in time for the next period of peak traffic as specified by the transportation authority.

The step of erecting a bridging unit, as shown in FIGS. 7A and 7B, is repeated until all of a predetermined number of bridging units are erected.

Figure 7C:
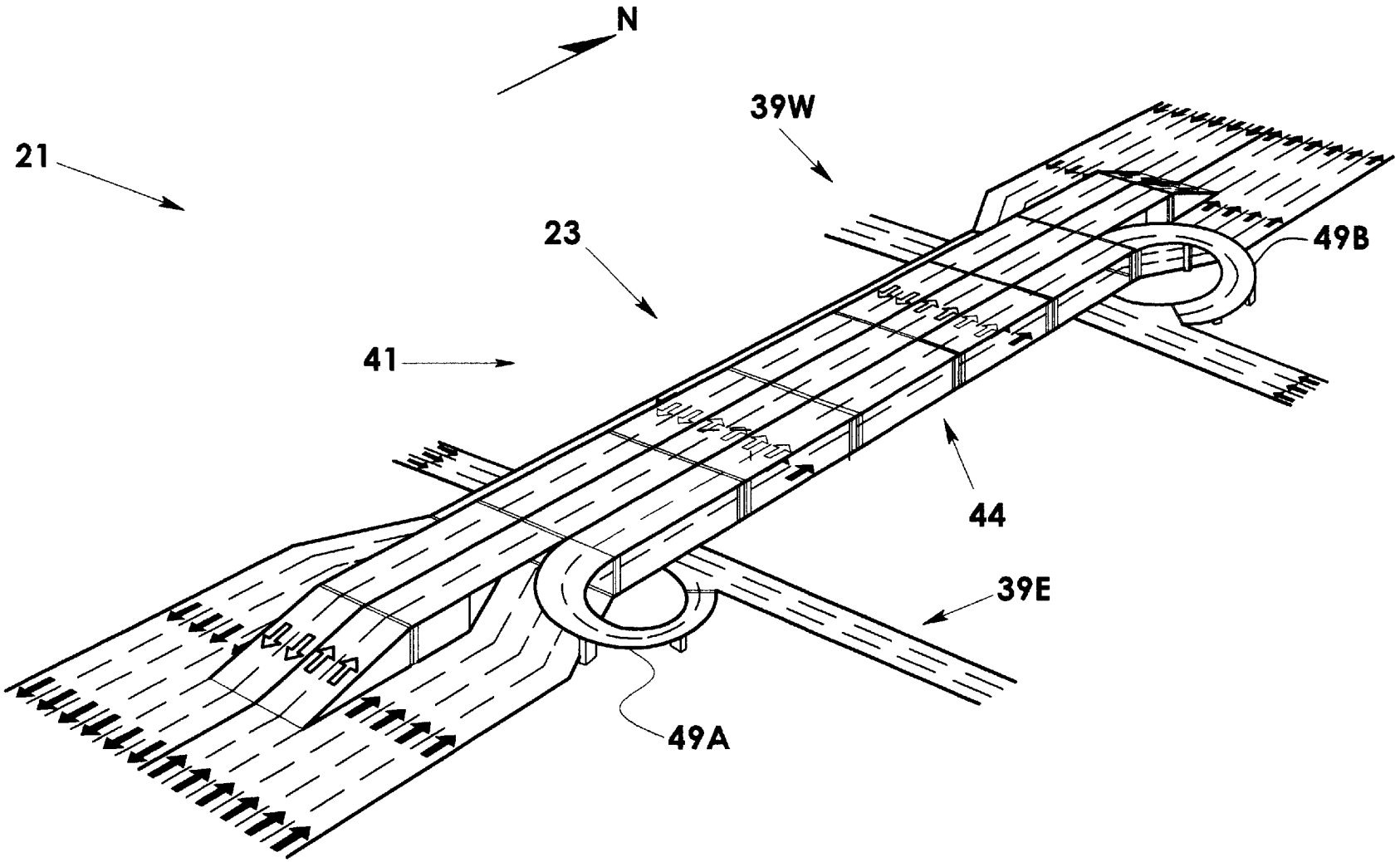
FIG. 7C shows a perspective view of the existing roadway, new elevated roadway, two local roadways, and of the additional new elevated roadway after its erection has been completed.

As shown in FIG. 7C, entrance/exit ramp units 49A and 49B and all bridging units of elevated roadway 44 have been erected and the entirely erected elevated roadway 44 is open to traffic from roadway 39E to roadway 39W as specified by the transportation authority.

Thus, by utilizing the alternative method, the new elevated roadway is erected with minimal disruption of existing traffic, because at each step, the existing roadway is open to existing traffic during periods of peak traffic, and the predetermined number of existing travel lanes is closed to existing traffic during periods of off-peak traffic.

In this example, it was shown that ramp unit 49A was erected at the beginning of erection of elevated roadway 44, and that ramp unit 49B was erected at the end of erecting elevated roadway 44. However, an option of erecting both ramp units at predetermined locations at the beginning of erecting elevated roadway 44 could have been utilized. It was also possible to utilize still another option of erecting both ramp units at the end of erecting elevated roadway 44.

These options provide opportunity to schedule erecting of ramp units and bridging units in such a way that disruption of existing traffic will be minimal.

In the previous examples ramp units and bridging units were shown to be erected as undivided units. Actually, however, ramp units and bridging units will most likely be erected from individual structural members or from pre-assembled sub-units.

The next example provides a detailed procedure for erecting bridging units from base sub-units and elevated sub-units. While the following procedure utilizes double-T-type main frames, this procedure applies equally to other types of main frames or sub-units.

Figure 8A:
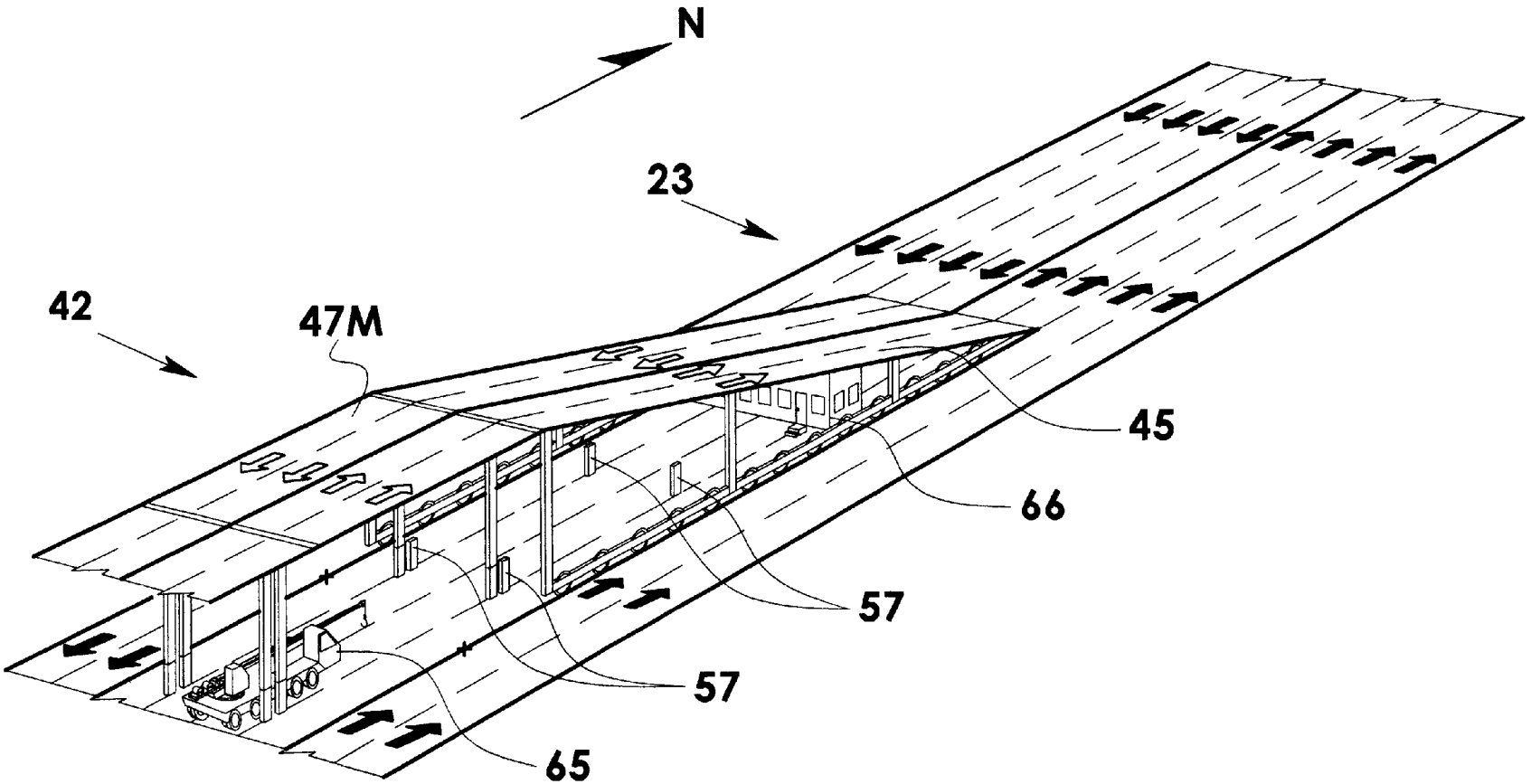
FIGS. 8A, 8B and 8C show detailed perspective views of the existing roadway during erection, in three consecutive sub-steps, respectively, of a bridging unit of a new elevated roadway.
Figure 8B:
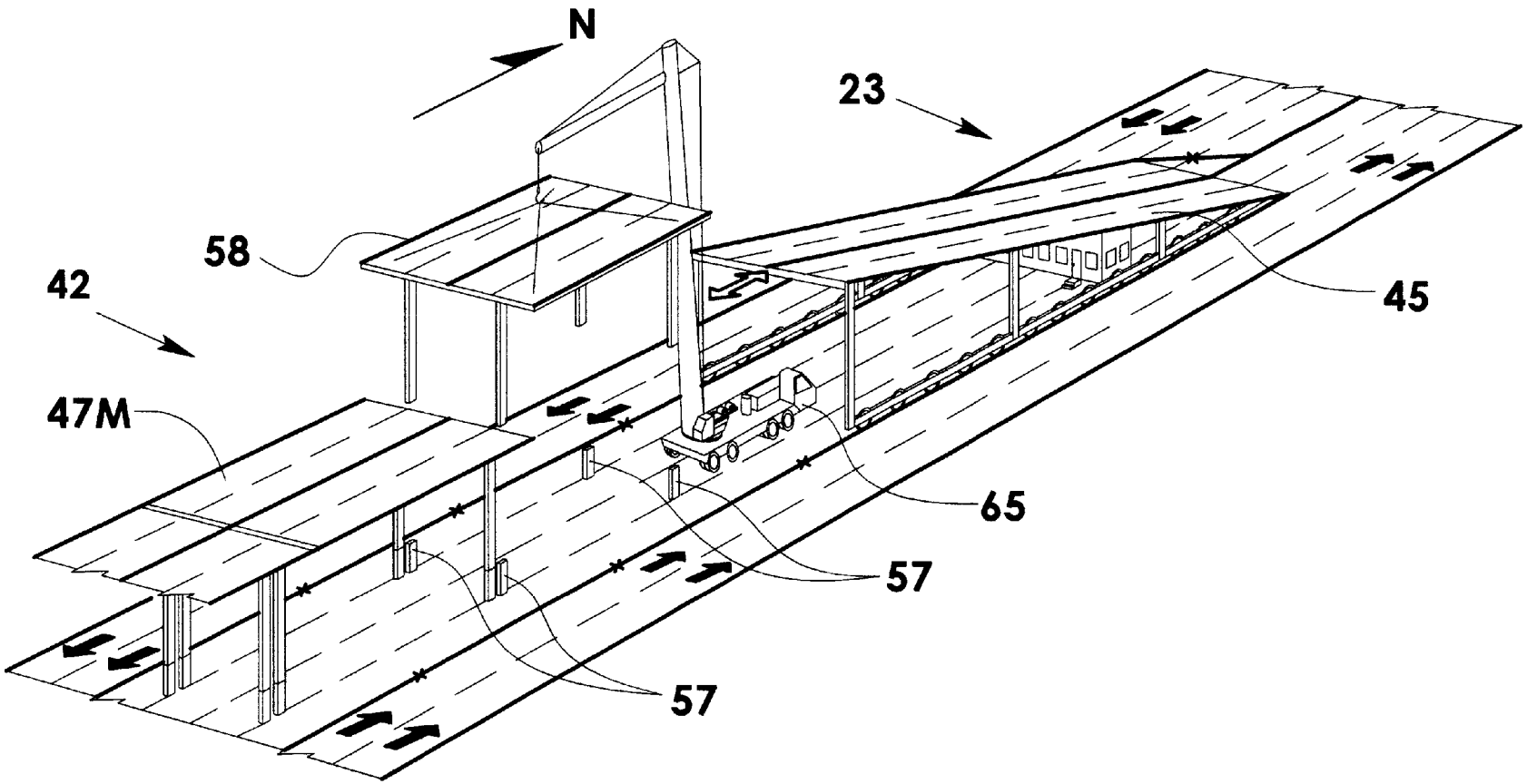
Figure 8C:
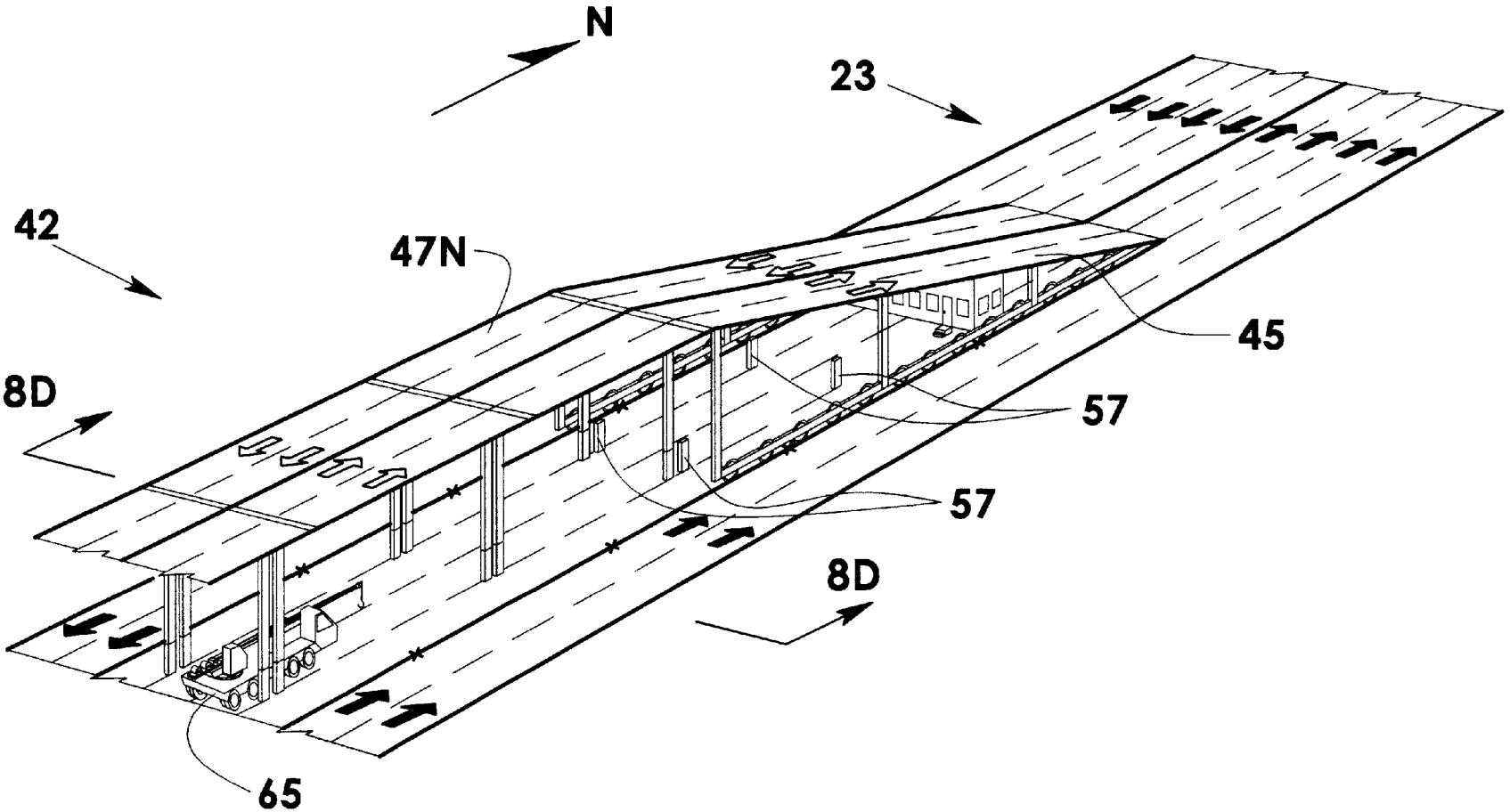

FIGS. 8A, 8B and 8C show detailed perspective views of the same existing bridge roadway 23 and a partially erected alternative new elevated roadway 42 during the erection of a bridging unit 47N in three consecutive sub-steps, respectively.

As seen in FIG. 8A, the erecting begins during a period of peak traffic with erecting of base sub-units 57 under a moveable ramp unit 45 while existing traffic is using elevated roadway 42 above the work area. Also seen in FIG. 8A are a previously erected bridging unit 47M, construction equipment 65, which is stored under elevated roadway 42, and a contractor's field office 66, which is built into ramp unit 45.

The erection of base sub-units 57 involves bringing in all necessary construction equipment and safety devices, surveying and making necessary adjustments to existing load-carrying structural members located beneath the surface of bridge roadway 23, installing base sub-units 57 and connecting them to the existing load-carrying members. Since the erecting is conducted under ramp unit 45, the work is performed during day time, with minimal time pressure and with minimal disruption of peak traffic on bridge roadway 23 and on elevated roadway 42.

FIG. 8B shows the second sub-step of erecting, which is performed during a period of off-peak traffic. The erecting involves closing elevated roadway 42 to existing traffic as specified by the transportation authority, creating a gap between the previously erected bridging unit 47M and ramp unit 45 by moving ramp unit 45 along bridge roadway 23. Then, construction equipment 65 is set up and an elevated sub-unit 58 is erected.

FIG. 8C shows that bridging unit 47N has been erected from base sub-units 57 and elevated sub-unit 58, which are connected above the existing roadway, ramp unit 45 has been moved back along roadway 23 to adjoin bridging unit 47N, construction equipment 65 has been stored under elevated roadway 42, construction barriers have been removed from bridge roadway 23, and an extended portion of elevated roadway 42 is opened in time for the next period of peak traffic as specified by the transportation authority.

It is also shown in FIG. 8C, that base sub-units 57 for the next bridging unit are erected under ramp unit 45 while existing traffic is using elevated roadway 42 above the work area. The work is again performed during daytime with minimal time pressure and with minimal disruption of peak traffic on bridge roadway 23 and elevated roadway 42. Thus, the erecting work continues during periods of peak traffic and periods of off-peak traffic.

It can be seen in FIGS. 8A and 8C that during periods of peak traffic two travel lanes in each direction of elevated roadway 42 are open to traffic in addition to two travel lanes in each direction of bridge roadway 23. This is equal to the traffic capacity of bridge roadway 23 (four travel lanes in each direction) prior to the beginning of erecting the new elevated roadway.

Also, as shown in FIG. 8B, two travel lanes in each direction are open during a period of off-peak traffic as required by the transportation authority. Therefore, traffic disruption during each sub-step of erecting bridging unit 47N is minimal.

Conclusion, Ramifications, and Scope of Invention

Thus, the reader will see that erecting a new elevated roadway above an existing roadway may be performed with minimal disruption of existing traffic using the methods of the present invention.

While the description above contains many specificities, these should not be construed as limitations on the scope of the invention but as merely providing illustrations of some of the presently preferred embodiments of this invention.

Many other variations are possible, for example:

The methods of the present invention are applicable to a great variety of different types of existing roadways carrying any number of existing travel lanes, and to elevated roadways carrying as many elevated travel lanes as required by transportation authorities.

Erection of a new elevated roadway using the preferred embodiment may originate at any predetermined location of an existing roadway and may progress in two opposite directions simultaneously by utilizing two moveable ramp units. Thus, erection time may be significantly shortened.

In order to minimize impact on traffic, a portion of the existing roadway, where the ramp units are erected, may be widened or the ramp units may be assembled off-site and erected on-site during periods of off-peak traffic.

Depending on traffic requirements during erecting a new elevated roadway, a moveable ramp unit may provide a lesser number of travel lanes than are provided by bridging units, thus reducing power requirements for moving the moveable ramp unit. In its final location, the moveable ramp unit may be replaced with a fixed entrance/exit ramp unit, that provides at least as many travel lanes as provided by the bridging units. Or, the moveable ramp unit may be fixed at its final location and additional travel lanes may be provided by erecting additional ramp units.

Since the width of travel lanes is standard, a moveable ramp unit can be assembled and disassembled from standard sub-units of easily transportable size. This modular moveable ramp unit can be transported to and be utilized on many different construction projects.

Ramp units may be split in order to provide direct access for fast-moving traffic and emergency vehicles to the leftmost travel lanes of an existing roadway underneath a new elevated roadway. Or ramp units may be split in order to provide direct access from an elevated travel lane to a predetermined travel lane of an existing roadway.

A new elevated roadway may be designated for "passenger cars only", thus providing a separation of car traffic and truck traffic. Traffic separation means, such as appropriate traffic signs, attenuating barriers, and traffic gates with overhead clearance tracking devices, may be installed on existing roadway's approaches to the new elevated roadway. Such elevated roadways may be used for alternating direction of traffic during periods of peak traffic to coincide with commuter needs.

Bridging units may be erected utilizing different types of main frames in order to accommodate existing roadway various traffic patterns, vertical clearance limitations, special use travel lanes, or incorporation of a light rail line.

Accordingly, the scope of the invention should be determined by the appended claims and their legal equivalents, rather than by the examples given.

What is claimed is:

1. A method of erecting a new elevated roadway atop an existing roadway with minimal disruption of existing traffic, said existing roadway, which is governed by a transportation authority, providing a plurality of existing travel lanes carrying said existing traffic along said existing roadway, said existing traffic having periods of peak traffic and periods of off-peak traffic, said new elevated roadway of a predetermined length disposed substantially above said existing travel lanes so that a longitudinal axis of said new elevated roadway is aligned mostly along said existing roadway, said new elevated roadway, providing a plurality of elevated travel lanes, comprises a predetermined number of bridging units and a predetermined number of ramp units, at least one of said ramp units shall be a moveable ramp unit equipped with means for propelling said moveable ramp unit along said existing roadway, each of said bridging units having a roadway deck oriented mostly parallel to said existing roadway, each of said ramp units having a mostly inclined roadway deck, said method comprising the steps of:

(a) erecting said predetermined number of said ramp units by:

(i) closing a predetermined portion of a predetermined number of said existing travel lanes to said existing traffic for a predetermined period of time after rerouting with minimal disruption said existing traffic onto the existing travel lanes that remain open to said existing traffic, (ii) erecting at least two of said ramp units, at least one of which shall be said moveable ramp unit, atop the closed portion of the existing travel lanes so that an uppermost end of said moveable ramp unit is adjacent to and faces an uppermost end of another of said ramp units, thereby creating a continuous portion of said new elevated roadway, which is prepared for passage of said existing traffic, and (b) repeatedly, until said predetermined number of said bridging units is erected:

(i) closing a previously erected portion of said new elevated roadway to said existing traffic during a period of off-peak traffic after rerouting with minimal disruption said existing traffic onto the existing travel lanes that remain open to said existing traffic, (ii) breaking continuity of said previously erected portion of said new elevated roadway by moving said moveable ramp unit along said existing roadway thereby creating a gap between said movable ramp unit and a remainder of said previously erected portion of said new elevated roadway, (iii) bridging said gap between said movable ramp unit and said remainder of said previously erected portion of said new elevated roadway by erecting at least one of said bridging units in the gap, thereby creating an extended portion of said new elevated roadway, which is continuous and is prepared for passage of said existing traffic, (iv) opening said extended portion of said new elevated roadway, which is continuous and is prepared for passage of said existing traffic, to said existing traffic prior to the next period of said peak traffic while rerouting with minimal disruption said existing traffic onto said extended portion of said new elevated roadway during said period of peak traffic, whereby traffic capacity of said existing roadway will be increased by an addition of said elevated roadway erected atop said existing roadway with minimal disruption of said existing traffic.

2. The method according to claim 1, further including the step of erecting traffic separation means above said existing roadway, whereby precluding truck traffic access to a predetermined number of the travel lanes designated as passenger cars only travel lanes.

3. The method according to claim 1, further including the step of replacing said moveable ramp unit with a fixed ramp unit at a predetermined location.

4. The method according to claim 1, further including the repeated steps of storing construction means underneath a previously erected portion of said new elevated roadway prior to the next period of peak traffic and of removing said construction means from underneath said previously erected portion of said new elevated roadway during periods of off-peak traffic.

5. The method according to claim 1, further including the step of performing erecting work underneath said moveable ramp unit during said periods of peak traffic.

6. The method according to claim 1, further including the step of widening a predetermined portion of said existing roadway by constructing a predetermined number of travel lanes, whereby disruption of existing traffic during erecting said new elevated roadway will be further minimized.

7. A method of erecting a new elevated roadway atop an existing roadway with minimal disruption of existing traffic, said existing roadway, which is governed by a transportation authority, providing a plurality of existing travel lanes carrying said existing traffic along said existing roadway, said existing traffic having periods of peak traffic and periods of off-peak traffic, said new elevated roadway of a predetermined length disposed substantially above said existing travel lanes so that a longitudinal axis of said new elevated roadway is aligned mostly along said existing roadway, said new elevated roadway, providing a plurality of elevated travel lanes, comprises a predetermined number of bridging units and a predetermined number of ramp units, at least one of said ramp units shall be a curved ramp unit, said curved ramp unit having curvature in a horizontal plane, each of said bridging units having a roadway deck oriented mostly parallel to said existing roadway, each of said ramp units having a mostly inclined roadway deck, said method comprising the steps of:

(a) repeatedly, until said predetermined number of said ramp units is erected:

(i) closing a predetermined portion of a predetermined number of said existing travel lanes to said existing traffic during a period of off-peak traffic after rerouting with minimal disruption said existing traffic onto the existing travel lanes that remain open to said existing traffic, (ii) erecting a predetermined portion of at least one of said ramp units above the closed portion of the existing travel lanes, (iii) opening the previously closed portion of the existing travel lanes beneath the previously erected portion of the ramp unit to said existing traffic prior to the next period of peak traffic and rerouting with minimal disruption said existing traffic onto the newly opened travel lanes, which are prepared for passage of said existing traffic, and (b) repeatedly, until said predetermined number of said bridging units is erected, (i) closing a predetermined portion of a predetermined number of said existing travel lanes to said existing traffic during a period of off-peak traffic after rerouting with minimal disruption said existing traffic onto the existing travel lanes that remain open to said existing traffic, (ii) erecting at least one of said bridging units at a predetermined location atop the previously closed portion of said existing travel lanes, (iii) opening the previously closed portion of the existing travel lanes beneath the previously erected bridging units to said existing traffic prior to the next period of peak traffic and rerouting with minimal disruption said existing traffic onto the newly opened travel lanes, which are prepared for passage of said existing traffic, whereby traffic capacity of said existing roadway will be increased by an addition of said elevated roadway erected atop said existing roadway with minimal disruption of said existing traffic.

8. The method according to claim 7, further including the step of erecting traffic separation means above said existing roadway, whereby precluding truck traffic access to a predetermined number of the travel lanes designated as passenger cars only travel lanes.

9. The method according to claim 7, further including the repeated steps of storing construction means atop a previously erected portion of said new elevated roadway prior to the next period of peak traffic and of removing said construction means from said previously erected portion of said new elevated roadway during periods of off-peak traffic.

10. The method according to claim 7, further including the step of performing erecting work atop a previously erected portion of said new elevated roadway during said periods of peak traffic.

11. The method according to claim 7, further including the step of widening a predetermined portion of said existing roadway by constructing a predetermined number of travel lanes, whereby disruption of existing traffic during erecting said new elevated roadway will be further minimized.

* * * * *